US012000394B2

(12) United States Patent
Park et al.

(10) Patent No.: US 12,000,394 B2
(45) Date of Patent: Jun. 4, 2024

(54) SCROLL COMPRESSOR

(71) Applicant: LG ELECTRONICS INC., Seoul (KR)

(72) Inventors: Gunyoung Park, Seoul (KR); Seokhwan Moon, Seoul (KR); Kitae Jang, Seoul (KR); Jongtae Her, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/993,605

(22) Filed: Nov. 23, 2022

(65) Prior Publication Data

US 2023/0228267 A1 Jul. 20, 2023

(30) Foreign Application Priority Data

Jan. 14, 2022 (KR) ..... 10-2022-0006067

(51) Int. Cl.

| | |
|---|---|
| ***F04C 29/02*** | (2006.01) |
| ***F01C 17/06*** | (2006.01) |
| ***F04C 15/00*** | (2006.01) |
| ***F04C 18/02*** | (2006.01) |
| ***F04C 29/00*** | (2006.01) |

(52) U.S. Cl.

CPC ..... *F04C 18/0215* (2013.01); *F04C 29/0042* (2013.01)

(58) Field of Classification Search

CPC ..... F04C 15/0065; F04C 18/0215; F04C 18/0246; F04C 18/0253; F04C 29/028; F04C 2240/50; F01C 17/066; F01C 17/063

See application file for complete search history.

(56) References Cited

U.S. PATENT DOCUMENTS

| | | | |
|---|---|---|---|
| 5,807,089 A | 9/1998 | Tsumagari et al. | |
| 10,634,141 B2 * | 4/2020 | Gossen | F04C 18/0215 |
| 11,092,155 B2 | 8/2021 | Sato et al. | |

(Continued)

FOREIGN PATENT DOCUMENTS

| | | |
|---|---|---|
| EP | 1160455 | 12/2001 |
| JP | H03-210001 | 9/1991 |

(Continued)

OTHER PUBLICATIONS

English KR 20090077295 translated by PE2E, Mar. 13, 2023.*

(Continued)

*Primary Examiner* — Deming Wan

(74) *Attorney, Agent, or Firm* — Fish & Richardson P.C.

(57) ABSTRACT

A scroll compressor is disclosed. The scroll compressor may include an anti-rotation mechanism provided with an anti-rotation pin and an anti-rotation ring between an orbiting scroll and a scroll support member facing the orbiting scroll, and an axial thickness of the ring body portion constituting the anti-rotation ring may be larger than an axial depth of a ring insertion groove in which the anti-rotation ring is inserted. This can allow the orbiting scroll and a member facing the same to be spaced physically apart without a separate member, to secure a gap for oil to flow, such that the oil can be smoothly supplied between the orbiting scroll and the member, thereby suppressing seizure or/and friction loss between the orbiting scroll and the member.

20 Claims, 17 Drawing Sheets

(56) References Cited

U.S. PATENT DOCUMENTS

| | | | | |
|---|---|---|---|---|
| 2014/0369819 | A1 | 12/2014 | Yamashita et al. | |
| 2017/0184107 | A1 | 6/2017 | Gossen et al. | |
| 2017/0211390 | A1* | 7/2017 | Takahata | F04C 18/0215 |
| 2017/0306962 | A1 | 10/2017 | Xu et al. | |
| 2020/0102956 | A1* | 4/2020 | Seong | F04C 18/0269 |
| 2020/0158109 | A1 | 5/2020 | Jo et al. | |
| 2020/0408208 | A1* | 12/2020 | Bron | F04C 23/008 |

FOREIGN PATENT DOCUMENTS

| | | | | |
|---|---|---|---|---|
| JP | 2001-055988 | | 2/2001 | |
| JP | 2016-200062 | | 12/2016 | |
| KR | 20090077295 | A * | 7/2009 | F04C 29/026 |
| WO | WO 200238960 | | 5/2002 | |

OTHER PUBLICATIONS

Extended European Search Report in European Appln. No. 22214526.0, dated May 31, 2023, 7 pages.

Notice of Allowance in Korean Appln. No. 10-2022-0006067, dated Jan. 25, 2023, 7 pages.

* cited by examiner

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2022-0006067, filed on Jan. 14, 2022, the contents of which are incorporated by reference herein in their entirety.

TECHNICAL FIELD

The present disclosure relates to a scroll compressor, and more particularly, an anti-rotation mechanism employing a pin and ring.

BACKGROUND

Generally, in a scroll compressor, compression chambers are formed while an orbiting scroll performs an orbiting motion relative to a fixed scroll or a non-orbiting scroll. The orbiting scroll is coupled to a rotational shaft to receive rotational force, but an anti-rotation mechanism is disposed between the orbiting scroll and a main frame or between the orbiting scroll and the non-orbiting scroll. Accordingly, the orbiting scroll performs an orbiting motion without rotation even when rotational force is transmitted.

Anti-rotation mechanisms are mainly classified into an Oldham ring type and a pin and ring type. For the Oldham ring type, keys formed at a ring are slidably coupled to an orbiting scroll and a member supporting the orbiting scroll with being interposed therebetween, to suppress rotation of the orbiting scroll. For the pin and ring type, a pin is coupled to a member supporting an orbiting scroll, and a ring into which the pin is pivotally inserted is disposed in the orbiting scroll, to suppress rotation of the orbiting scroll. Of course, in the pin and ring type, the positions of the pin and the ring may be arranged oppositely, but hereinafter, a type in which a ring is coupled to an orbiting scroll will be mainly described.

In some examples, a pin and ring type is applied in a so-called 'hermetic compressor', in which a drive motor constituting a driving source is disposed inside a casing. In this case, a pin is inserted into a main frame and a ring is inserted into an orbiting scroll, with interposing a thrust plate between the main frame and the orbiting scroll.

In some examples, a pin-and-ring type is applied in a so-called 'open compressor', in which a gas engine constituting a driving source is provided outside a casing to transmit driving force through a drive shaft exposed to the outside of the casing. In this case, a pin is inserted into an orbiting scroll and a ring is inserted into a front housing, with interposing a thrust plate between the front housing and the orbiting scroll.

However, since the related art anti-rotation ring as described above is completely embedded in a ring insertion groove of the orbiting scroll, the orbiting scroll is brought into close contact with the thrust plate or the orbiting scroll and the front housing (main frame) are brought into close contact with each other when the thrust plate is not provided. As a result, sufficient oil is not supplied to a bearing surface between the orbiting scroll and the thrust plate. This may cause wear due to an increase in friction loss or an occurrence of seizure on the bearing surface. This may occur more severely in a scroll compressor in which an oil separator is disposed at the exterior of a casing as well as a horizontal scroll compressor in which it is difficult to dispose an oil pump.

SUMMARY

The present disclosure describes a scroll compressor, capable of suppressing seizure or/and friction loss between an orbiting scroll and a member facing the same when a pin and ring type anti-rotation mechanism is applied.

The present disclosure also describes a scroll compressor, capable of feeding oil smoothly between an orbiting scroll and a member facing the orbiting scroll.

The present disclosure further describes a scroll compressor, capable of securing a gap, through which oil can be introduced, by physically spacing an orbiting scroll apart from a member facing the orbiting scroll.

The present disclosure further describes a scroll compressor, capable of physically spacing an orbiting scroll apart from a member facing the orbiting scroll by using existing parts.

The present disclosure further describes a scroll compressor, capable of storing oil in a member by which an orbiting scroll is physically spaced apart from a member facing the orbiting scroll.

The present disclosure further describes a scroll compressor, capable of securing reliability of a member by which an orbiting scroll is physically spaced apart from a member facing the orbiting scroll.

In order to achieve those aspects and other advantageous of the subject matter disclosed herein, there is provided a scroll compressor that may include a casing, a fixed scroll, an orbiting scroll, an anti-rotation pin, a ring insertion groove, and an anti-rotation ring. The fixed scroll may be fixed to an inside of the casing. The orbiting scroll may be engaged with the fixed scroll to define compression chamber together with the fixed scroll while performing an orbiting motion. The scroll support member may be disposed on one side of the orbiting scroll in an axial direction to support the orbiting scroll in the axial direction. The anti-rotation pin may be disposed on one of one side surface of the orbiting scroll and one side surface of the scroll support member facing the one side surface of the orbiting scroll. The ring insertion groove may be disposed in one side surface of a member facing another member provided with the anti-rotation pin. The anti-rotation ring may be provided with a ring body portion rotatably inserted into the ring insertion groove, and a pin coupling portion disposed in the ring body portion such that the anti-rotation pin is coupled thereto. An axial thickness of the ring body portion may be larger than an axial depth of the ring insertion groove. This can allow the orbiting scroll and a member facing the same to be spaced physically apart without a separate member, to secure a gap for oil to flow, such that the oil can be smoothly supplied between the orbiting scroll and the member, thereby suppressing seizure or/and friction loss between the orbiting scroll and the member.

In one example, the axial thickness of the ring body portion may be smaller than or equal to twice the axial depth of the ring insertion groove. This can allow the orbiting scroll and the member facing the same to be appropriately spaced apart from each other, such that oil can be smoothly introduced between the orbiting scroll and the member and unstable behavior of the orbiting scroll can be suppressed.

In another example, the pin coupling portion may be disposed eccentrically from a center of the ring body portion. Accordingly, the anti-rotation pin can be coupled to a predetermined position of the anti-rotation ring, and the anti-rotation pin can perform an orbiting motion relative to the anti-rotation ring while effectively constraining a rotation of the orbiting scroll.

In another example, the pin coupling portion may be formed through both side surfaces of the ring body portion in the axial direction or recessed from any one of the body side surfaces by a preset depth. An inner diameter of the pin coupling portion may be larger than an outer diameter of the anti-rotation pin. With this configuration, the anti-rotation pin can be coupled to a predetermined position in the anti-rotation ring, and can perform the orbiting motion while sliding in the circumferential direction with respect to the anti-rotation ring.

Specifically, one end of the anti-rotation pin may be fixedly coupled to the scroll support member, and another end of the anti-rotation pin may be rotatably coupled to the pin coupling portion. As the anti-rotation pin is fixed to the scroll support member, the anti-rotation pin can be easily coupled to the anti-rotation ring.

In another example, the anti-rotation pin may integrally extend from the pin coupling portion. A pin insertion groove may be formed in the scroll support member such that the anti-rotation pin is rotatably coupled thereto. Since the anti-rotation pin and the anti-rotation ring are integrally formed with each other, an assembling process between the anti-rotation pin and the anti-rotation ring can be excluded, thereby facilitating assembling of an anti-rotation mechanism.

In another example, the ring body portion may be formed in a disk shape entirely blocked except for the pin coupling portion. This can increase a sliding area of the anti-rotation ring substantially defining an axial bearing surface, which can result in stably supporting the orbiting scroll and reducing surface pressure of the anti-rotation ring, thereby securing reliability.

Specifically, the ring body portion may entirely have the same thickness. This can uniformly maintain a bearing surface of the anti-rotation ring, thereby stabilizing a behavior of the orbiting scroll and further improving reliability of the anti-rotation ring.

In another example, a weight-reducing portion may be disposed in the ring body portion at one side of the pin coupling portion. This can reduce a weight of the anti-rotation ring defining a substantial axial bearing surface, thereby improving efficiency of the compressor. In addition, oil can be stored in the weight-reducing portion so as to be quickly supplied between the orbiting scroll and the member facing the same when the compressor is turned on again.

Specifically, the ring body portion may include a reinforcing portion disposed between the weight-reducing portion and the pin coupling portion to surround the pin coupling portion. This can reduce a weight of the anti-rotation ring and stably support the anti-rotation pin.

More specifically, an area of the reinforcing portion may be smaller than or equal to an area of the weight-reducing portion. This can minimize a weight of the anti-rotation ring and stably support the anti-rotation pin.

The reinforcing portion may be formed as the weight-reducing portion is spaced apart from the pin coupling portion in a radial direction. An outer circumferential surface of the reinforcing portion may be formed as a curved surface having the same center as that of the pin coupling portion. This can minimize a width of the reinforcing portion while stably supporting the anti-rotation pin, thereby minimizing the weight of the anti-rotation ring.

Specifically, an outer diameter of the reinforcing portion may be twice larger than or equal to or four times smaller than or equal to an inner diameter of the pin coupling portion. This can optimize the reinforcing portion of the anti-rotation ring so as to minimize the weight of the anti-rotation ring and secure reliability of the anti-rotation ring including the reinforcing portion.

The weight-reducing portion may be formed through both side surfaces of the ring body portion in the axial direction. This can minimize the weight of the anti-rotation ring including the pin coupling portion, and store oil in the anti-rotation ring, thereby effectively suppressing seizure and friction loss when the compressor is turned on again.

The weight-reducing portion may be recessed from one side surface of the ring body portion in the axial direction. This can reduce the weight of the anti-rotation ring including the pin coupling portion and enhance rigidity of the pin coupling portion. This can also lower surface pressure of the anti-rotation ring according to an installation direction of the ring body portion, to enhance reliability and stably support the orbiting scroll. Also, oil can be stored in the anti-rotation ring, so as to effectively suppress seizure and friction loss when the compressor is turned on again.

In order to achieve those aspects and other advantageous of the subject matter disclosed herein, there is provided a scroll compressor that may include a casing, a fixed scroll, an orbiting scroll, an anti-rotation pin, a ring insertion groove, and an anti-rotation ring. The fixed scroll may be fixed to an inside of the casing. The orbiting scroll may be engaged with the fixed scroll to define compression chamber together with the fixed scroll while performing an orbiting motion. The scroll support member may be disposed on one side of the orbiting scroll in an axial direction to support the orbiting scroll in the axial direction. The anti-rotation pin may be disposed on one of one side surface of the orbiting scroll and one side surface of the scroll support member facing the one side surface of the orbiting scroll. The ring insertion groove may be disposed in one side surface of a member facing another member provided with the anti-rotation pin. The anti-rotation ring may be provided with a ring body portion rotatably inserted into the ring insertion groove, and a pin coupling portion disposed in the ring body portion such that the anti-rotation pin is coupled thereto. The pin coupling portion may be disposed eccentrically from a center of the ring body portion. Accordingly, the anti-rotation pin can be coupled to a predetermined position of the anti-rotation ring, and the anti-rotation pin can perform an orbiting motion relative to the anti-rotation ring while effectively constraining a rotation of the orbiting scroll.

In one example, an oil groove may be formed in one side surface of the scroll support member facing the orbiting scroll. The oil groove may be formed to connect between an outer circumferential surface and an inner circumferential surface of the scroll support member. With the configuration, oil can be quickly supplied between a scroll support surface of a front housing and a member facing it.

Specifically, an oil separator for separating oil from refrigerant discharged from the casing may be disposed outside the casing. An oil return pipe may be disposed to connect the oil separator and an inside of the casing. The oil return pipe may be connected to the inside of the casing at a position where the same faces a portion between the orbiting scroll and the scroll support member in a radial direction. When the oil separator is disposed outside the compressor, oil separated in the oil separator can be smoothly and quickly supplied to an axial bearing surface between the front housing and the orbiting scroll constituting a sliding part inside the compressor.

DETAILED DESCRIPTION

Description will now be given in detail of a scroll compressor according to exemplary embodiments disclosed herein, with reference to the accompanying drawings. A scroll compressor according to the present disclosure employs a pin-and-ring type anti-rotation mechanism, and a horizontal scroll compressor, which constitutes a typical air conditioning refrigeration cycle together with a condenser, an expander, and an evaporator, in a gas engine heat pump will be described as an example.

However, the present disclosure relates to a pin-and-ring type anti-rotation mechanism commonly applied to a scroll compressor and hence is not limited to the horizontal scroll compressor for the gas engine heat pump. In other words, the pin-and-ring type anti-rotation mechanism according to the present disclosure can be commonly applied to an orbiting scroll. In the case of the horizontal scroll compressor for the gas engine heat pump, however, a casing has a small volume and an installation of an oil pump is limited, which may make it difficult to feed oil into a gap between an orbiting scroll and a scroll support member supporting the orbiting scroll, compared to other types of compressors. Hereinafter, a horizontal scroll compressor for a gas engine heat pump will be mainly described.

Figure 1:
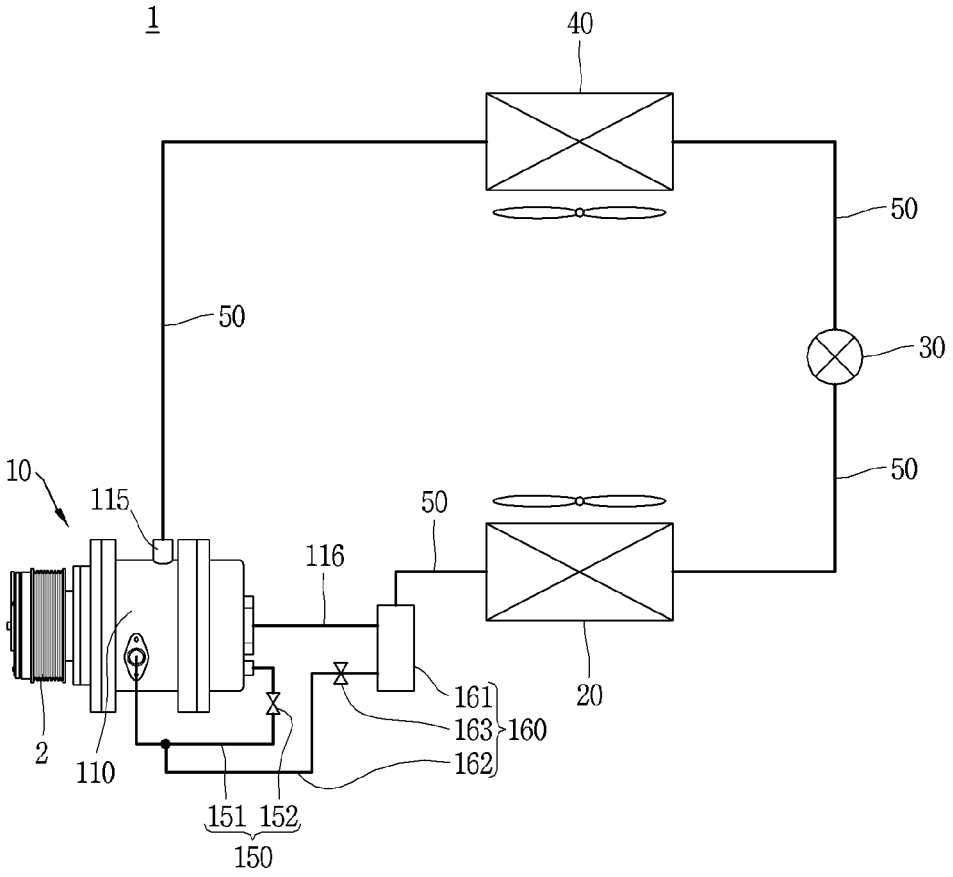
FIG. 1 is a schematic view illustrating a gas engine heat pump in accordance with an embodiment of the present disclosure.

FIG. 1 is a schematic view illustrating a gas engine heat pump in accordance with an embodiment of the present disclosure.

Referring to FIG. 1, a gas engine heat pump 1 according to an embodiment includes a compressor 10, a condenser 20, an expander 30, and an evaporator 40 which define a closed loop. That is, the condenser 20, the expander 30, and the evaporator 40 are sequentially connected to a discharge side of the compressor 10 and the evaporator 40 is connected to a suction side of the compressor 10.

In this embodiment, an oil separator 161 to be described later is disposed at the discharge side of the compressor 10, that is, between the compressor 10 and the condenser 20. A first outlet side of the oil separator 161 is connected to a refrigerant circulation pipe 50 connected to the condenser 20, and a second outlet side of the oil separator 161 is connected to an oil return pipe 162 that faces the suction side of the compressor 10.

In the drawings, reference numeral 2 denotes a clutch assembly, and 151 denotes a refrigerant return pipe.

In the gas engine heat pump 1 as described above, refrigerant compressed in the compressor 10 is discharged toward the condenser 20, after passing through the oil separator 161 located at an upstream side of the condenser 20. Refrigerant and oil are separated in the oil separator 161. The refrigerant sequentially passes through the refrigeration cycle including the condenser 20, the expander 30, and the evaporator 40 and is suctioned back into the compressor 10, while the oil returns to the compressor 10 from the oil separator 161 through the oil return pipe 162 without passing through the refrigeration cycle.

However, the oil return pipe 162 may be connected to (joined together with) the refrigerant suction pipe 115 to be connected to the suction side of the compressor 10, but this may increase a specific volume of refrigerant suctioned into a compression chamber V as described above, thereby lowering volumetric efficiency of the compressor. Therefore, in this embodiment, it is advantageous to dispose the oil return pipe 162 in a manner that an axial bearing surface between a front housing 112 and an orbiting scroll 130 to be described later can be effectively lubricated by oil while a point where the oil return pipe 162 is connected to a casing is spaced as far as possible from a point where the refrigerant suction pipe 115 is connected to the casing.

Figure 2:
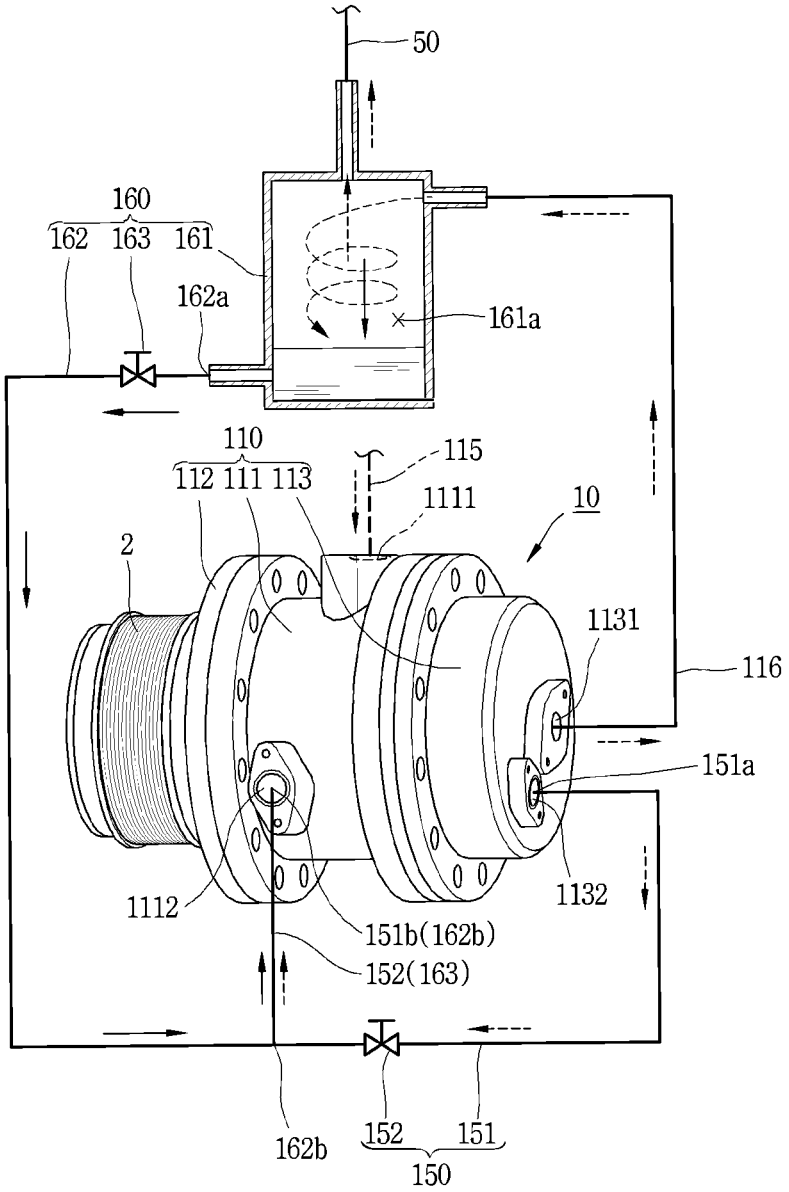
FIG. 2 is a schematic view illustrating a connection relation between a compressor and an oil return unit in FIG. 1.
Figure 3:
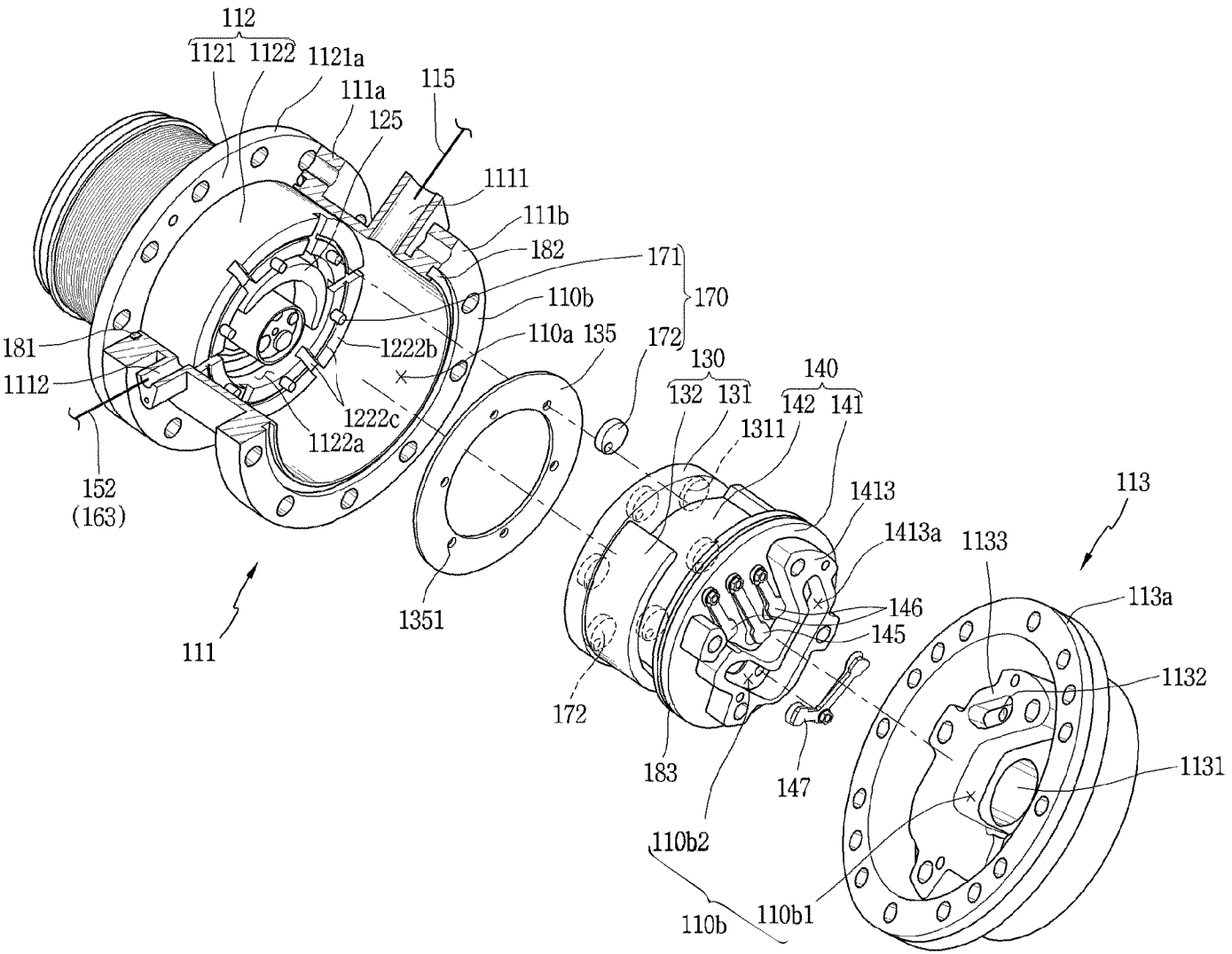
FIG. 3 is an exploded perspective view illustrating a portion of the compressor in FIG. 2.
Figure 4:
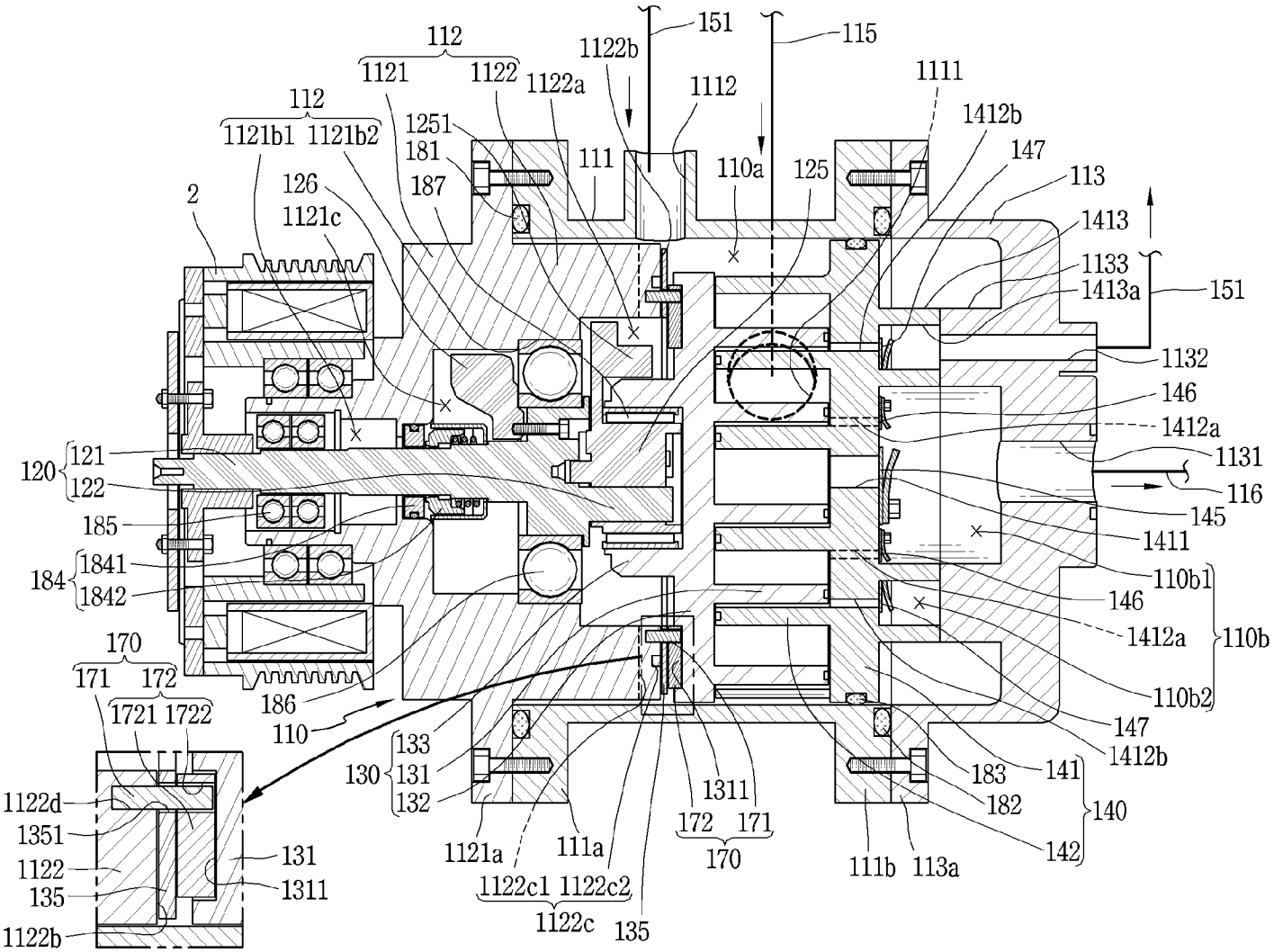
FIG. 4 is an assembled cross-sectional view of FIG. 3.

FIG. 2 is a schematic view illustrating a connection relation between a compressor and an oil return unit in FIG. 1, FIG. 3 is an exploded perspective view illustrating a portion of the compressor in FIG. 2, and FIG. 4 is an assembled cross-sectional view of FIG. 3.

As illustrated in these drawings, the scroll compressor 10 according to the embodiment includes a casing 110, a drive shaft 120, an orbiting scroll 130 and a fixed scroll 140 constituting a compression part, a refrigerant return unit 150, and an oil return unit 160.

The casing 110 includes a main housing 111, a front housing 112, and a rear housing 113.

The casing 110 defines appearance of the compressor 10. The casing 110 is disposed on one side of the clutch assembly 2 and coupled to the clutch assembly 2 by the drive shaft 120. Hereinafter, a side facing the clutch assembly 2 is defined as the front and an opposite side as the rear, and a description will be given based on the definition. Accordingly, the front housing 112 refers to a housing disposed on the side facing the clutch assembly 2, and the rear housing 113 refers to a housing disposed on the opposite side.

The main housing 111 is formed in a cylindrical shape with both ends open so as to receive the compression part. In other words, an inner space of the main housing 111 forms a suction space 110*a* into which refrigerant passing through the evaporator 40 is suctioned. However, the suction space of the main housing 111 also defines an oil sump, in which not only refrigerant but also oil for lubricating a sliding part including the compression part are stored.

One end (front end) of the main housing 111 is covered with the front housing 112 coupled thereto, and another end (rear end) of the main housing 111 is covered with the rear housing 113 coupled thereto. Accordingly, the inner space of the main housing 111 is sealed by the front housing 112 and the rear housing 113. However, since the drive shaft 12 is inserted through the front housing 112, a shaft sealing member 184, which will be described later, is disposed between the front housing 112 and the drive shaft 120. Accordingly, the front end of the main housing 111 is sealed by the front housing 112 and the shaft sealing member 184, but for convenience, hereinafter, a description will be given of an example in which one end of the main housing 111 is sealed by the front housing 112.

The front housing 112 and the rear housing 113 may be coupled to the main housing 111 in a welding manner or by bolts. In this embodiment, an example in which the front housing 112 and the rear housing 113 are fastened to the main housing 111 by bolts will be mainly described.

A first housing protrusion 111*a* protrudes from one end of the main housing 111 into in a flange shape. The first housing protrusion 111*a* is fastened by bolts to a cover portion 1121 of the front housing 112 to be described later. A first sealing member 181 such as an O-ring or a gasket may be inserted between the first housing protrusion 111*a* and the cover portion 1121.

A second housing protrusion 111*b* protrudes from a rear end of the main housing 111 into in a flange shape. The second housing protrusion 111*b* is fastened by bolts to a third housing protrusion 113*a* of the rear housing 113 to be described later. A second sealing member 182 such as an O-ring or a gasket may be inserted between the second housing protrusion 111*b* and the third housing protrusion 113*a*.

A first connection protrusion (no reference numeral given) is formed on an outer circumferential surface of the main housing 111, that is, on an outer circumferential surface between the first housing protrusion 111*a* and the second housing protrusion 111*b*. A refrigerant suction port 1111 111 is formed in the first connection protrusion to penetrate through between outer and inner surfaces of the main housing. An outer end of the refrigerant suction port 1111 is connected to the refrigerant suction pipe 115, and an inner end of the refrigerant suction port 1111 is open to an inner circumferential surface of the main housing 111. Accordingly, the refrigerant suction pipe 115 communicates with the inner space of the casing 110, i.e., the suction space 110*a* through the refrigerant suction port 1111.

The refrigerant suction port 1111 may be formed at a middle position of the main housing 111, but may be located to be as close as possible to a first suction end 132*a* to be described later. For example, the first suction port 1111 may be located to be closer to the second housing protrusion 111*b* than to the first housing protrusion 111*a*. Accordingly, the refrigerant suction port 1111 is brought close to the first suction end 132*a*, which will be described later, so that suction resistance of refrigerant suctioned into the compression chamber V through the refrigerant suction port 1111 can be reduced.

A second connection protrusion (no reference numeral given) is formed on an outer circumferential surface of the main housing 111, that is, on an outer circumferential surface between the first housing protrusion 111*a* and the second housing protrusion 111*b*. A return port 1112 is formed in the second connection protrusion to penetrate through between outer and inner surfaces of the main housing 111. An outer end of the return port 1112 is connected to the refrigerant suction pipe 151, and an inner end of the return port 1112 is open to an inner circumferential surface of the main housing 111. Accordingly, the refrigerant suction pipe 151 (or oil return pipe) communicates with the inner space of the casing 110, i.e., the suction space 110*a* through the return port 1112.

The return port 1112 may be located to be close to the axial bearing surface between the front housing 112 and the orbiting scroll 130. For example, the return port 1112 may be formed at a position where it radially overlaps the axial bearing surface between the first housing protrusion 111*a* and the refrigerant suction port 1111. Accordingly, oil returned to the suction space 110*a* of the casing 110 through the return port 1112 can be quickly fed to the axial bearing surface between the front housing 112 and the orbiting scroll 130, so as to increase a lubricating effect between the front housing 112 and the orbiting scroll 130.

The front housing 112 is coupled to the front end of the main housing 111 to seal the inner space of the main housing 111, that is, the suction space 110*a*, and simultaneously support the orbiting scroll 130 in the axial direction. Accordingly, the front housing 112 may be understood as a portion of the casing 110 or as a frame constituting a portion of the compression part.

The front housing 112 may be formed of an aluminum material to reduce a weight of the compressor when applied to a vehicle. However, since a compressor applied for building air conditioning is fixed to an outdoor unit, the front housing 112 may be made of cast iron material instead of the aluminum material. This can increase reliability of the compressor for the building air conditioning, which has a higher load than the compressor for the vehicle.

Specifically, the front housing 112 according to the embodiment includes a cover portion 1121 and a frame portion 1122. The cover portion 1121 defines a portion of the casing 110 and the frame portion 1122 defines a portion of the compression part.

The cover portion 1121 and the frame portion 1122 may be integrally formed with each other or may be separately manufactured to be assembled with each other. Although the embodiment illustrates an example in which the cover portion 1121 and the frame portion 1122 are integrally formed with each other, the present disclosure may be equally applied to a case where the cover portion 1121 and the frame portion 1122 are separately manufactured and assembled with each other later.

The cover portion 1121 of the front housing 112 according to the embodiment is a portion that covers the front end of the main housing 111 from the outside of the main housing 111, and is formed as a whole in the shape of an annular circular plate with a hollow center. An outer diameter of the cover portion 1121 may be substantially the same as an outer diameter of the main housing 111, more precisely, an outer diameter of the first housing protrusion 111*a*. Accordingly, the cover portion 1121 is fastened by bolts to the first housing protrusion 111*a* of the main housing 111 to cover the front end of the main housing 111.

A cover protrusion 1121*a* that extends toward the clutch assembly 2 on the same axis is formed on a front surface of the cover portion 1121. The cover protrusion 1121*a* is inserted and supported in the clutch assembly 2 with a clutch bearing (no reference numeral given) interposed therebetween. Accordingly, a drive part (no reference numeral given) of the clutch assembly 2 may be rotatably supported with respect to the cover protrusion 1121*a*.

A shaft receiving portion 1121*b* is formed through an inside of the cover portion 1121. The shaft receiving portion 1121*b* is formed on the same axis as an orbiting space 1122*a* of the frame portion 1122 to be described later. Accordingly, the drive shaft 120 is inserted through the shaft receiving portion 1121*b* of the cover portion 1121 and the orbiting space 1122*a* of the frame portion 1122, such that a front end of the drive shaft 120 is coupled to the clutch assembly 2 and a rear end to the orbiting scroll 130, respectively.

The shaft receiving portion 1121*b* may be formed to be multiply stepped. For example, a front side of the shaft receiving portion 1121*b* may have a small inner diameter and a rear side thereof may have a large inner diameter. A front shaft receiving portion 1121*b*1 may be provided with a first support bearing 185 for supporting the front side of the drive shaft 120, and a rear shaft receiving portion 1121*b*2 may be provided with a second support bearing 186 for supporting the rear side of the drive shaft 120.

The first support bearing 185 and the second support bearing 186 may be configured as ball bearings. However, in some cases, the first support bearing 185 and the second support bearing 186 may be configured as needle bearings or bush bearings. However, as the orbiting scroll 130 constituting the compression part is coupled to the rear side of the drive shaft 120, the second support bearing 186 is preferably configured as a bearing having a relatively large load bearing capacity compared to the first support bearing 185.

In addition, a lubrication space 1121*c* may be defined in one side of the shaft receiving portion 1121*b*, that is, between the front shaft receiving portion 1121*b*1 and the rear shaft receiving portion 1121*b*2. An inner diameter of the lubrication space 1121*c* may be larger than an inner diameter of the front shaft receiving portion 1121*b*1 and smaller than an inner diameter of the rear shaft receiving portion 1121*b*2. Accordingly, the inner diameter may increase step by step from the front shaft receiving portion 1121*b*1 to the rear shaft receiving portion 1121*b*2 through the lubrication space 1121*c*.

A shaft sealing member 184 is disposed in the lubrication space 1121*c*. Specifically, the shaft sealing member 184 may be located between the first support bearing 185 and the second support bearing 186, that is, between the lubrication space 1121*c* and the front shaft receiving portion 1121*b*1. Thus, a portion of the shaft sealing member 184 is located in the front shaft receiving portion 1121*b*1 and another portion in the lubrication space 1121*c*.

The shaft sealing member 184 may be usually configured as a mechanical seal. For example, the shaft sealing member 184 may include a fixed sealing portion 1841 and a movable sealing portion 1842. The fixed sealing portion 1841 may be coupled to an inner circumferential surface of the front shaft receiving portion 1121*b*1, and the movable sealing portion 1842 may be coupled to an outer circumferential surface of the drive shaft 120, respectively. Accordingly, when the drive shaft 120 rotates, the movable sealing portion 1842 is brought into close contact with the fixed sealing portion 1841 to seal a gap between the front shaft receiving portion 1121*b*1 and the lubrication space 1121*c*, that is, the front side of the suction space 110*a*.

The frame portion 1122 of the front housing 112 is a portion inserted into the main housing 111 and extends integrally from the cover portion 1121 toward the rear housing 113. Accordingly, there is no need to fasten the cover portion 1121 and the frame portion 1122, which can facilitate the formation of the front housing 112. However, as described above, the frame portion 1122 may be manufactured separately from the cover portion 1121, and then coupled to the cover portion 1121 by bolts. In this case, the second support bearing 186 and the shaft sealing member 184 can be easily assembled.

An outer circumferential surface of the frame portion 1122 may be coupled to an upper circumferential surface of the main housing substantially in a close contact manner. In other words, the front housing 112 may be shrink-fitted or welded to the casing 110. However, in this embodiment, as the front housing 112 is fastened by bolts to the main housing 111, the outer circumferential surface of the front housing 112 may be spaced apart from the inner circumferential surface of the main housing 111. This can suppress heat or vibration of the front housing 112 from being transferred to the main housing 111.

Although not illustrated, as the frame portion 1122 is inserted into the main housing 111, a first sealing member (not illustrated) may be disposed between an outer circumferential surface of the frame portion 1122 and an inner circumferential surface of the main housing 111 facing the same.

The frame portion 1122 is formed in an annular shape, and the orbiting space 1122*a* is defined in a central portion. The orbiting space 1122*a* is a space in which a drive shaft coupling portion 133 of the orbiting scroll 130 to be described later performs an orbiting motion, and is formed through the frame portion 1122 to communicate with the shaft receiving portion 1121*b* and the lubricating space 1121*c* on the same axis.

A rear surface of the frame portion 1122 defines a scroll support surface 1122*b*. In other words, the rear surface of the frame portion 1122 facing the orbiting scroll 130 defines the scroll support surface 1122*b* on which an orbiting end plate 131 to be described later is supported in the axial direction. Accordingly, the scroll support surface 1122*b* defines the axial bearing surface described above together with a front surface of the orbiting end plate 131 facing the scroll support surface 1122*b*.

The scroll support surface 1122*b* may be formed to be flat as a whole, or at least one oil groove 1122*c* may be formed so that the scroll support surface 1122*b* is uneven. The oil groove may alternatively be formed in the front surface of the orbiting end plate 131 facing the scroll support surface 1122*b*. In this embodiment, an example in which the oil grooves 1122*c* are formed in the scroll support surface 1122*b* is illustrated.

For example, the oil grooves 1122*c* may include a first oil groove 1122*c*1 and a second oil groove 1122*c*2. The first oil groove 1122*c*1 is provided in plurality in a radial direction, and the second oil groove 1122*c*2 is provided by at least one in number to intersect the first oil grooves 1121*c*1 in the circumferential direction. In other words, the plurality of first oil grooves 1122*c*1 are disposed at predetermined distances along the circumferential direction, whereas the second oil groove 1122*c*2 may be formed across the first oil grooves 1122*c*1. Accordingly, the plurality of first oil grooves 1122*c*1 can communicate with one another by the second oil groove 1122*c*2.

Also, the first oil grooves 1122*c*1 may be disposed at an equal distance in the circumferential direction. In other words, the first oil grooves 1122*c*1 may be formed at the same oil groove distance a along the circumferential direction. This can facilitate the formation of the first oil grooves 1122*c*1 and simultaneously allow oil to be approximately equally supplied to the entire axial bearing surface.

In addition, the first oil groove 1122*c*1 may be formed in the same standard, that is, the same width and depth. In other words, the first oil grooves 1122*c*1 may have the same oil groove width β along the circumferential direction. This can facilitate the formation of the first oil grooves 1122*c*1 and simultaneously allow oil to be approximately equally supplied to the entire axial bearing surface.

The second oil groove 1122*c*2 may be one groove formed across middle portions of the first oil grooves 1122*c*1 or may include a plurality of circular grooves spaced apart in the radial direction. The second oil groove 1122*c*2 may have the same depth as the first oil groove 1122*c*1.

Although not illustrated, the first oil grooves 1122*c*1 and the second oil supply groove 1122*c*2 may be formed in various shapes. For example, the first oil groove 1122*c*1 may be formed in a tapered shape having a wide outer circumference and a narrow inner circumference, and the second oil groove 1122*c*2 may be formed in a linear shape.

Although not illustrated, the oil groove 1122*c* may not be configured as the first oil grooves 1122*c*1 and the second oil groove 1122*c*2. For example, the oil groove 1122*c* may include only the first oil grooves 1122*c*1 or only the second oil groove 1122*c*2.

Although not illustrated, the first oil grooves 1122*c*1 may be formed in different standards at different distances along the circumferential direction.

On the other hand, an anti-rotation pin 171 constituting an anti-rotation mechanism 170 together with a ring insertion groove (or anti-rotation ring) to be described later is disposed on the scroll support surface 1122*b*. The anti-rotation pin 171 is provided in plurality disposed at preset distances, for example, between the neighboring oil grooves 1122*c* to be described later, in the circumferential direction. Accordingly, the anti-rotation pins 171 suppress the rotation of the orbiting scroll 130 together with a ring insertion groove (or anti-rotation ring) 1311 to be described later. The anti-rotation pin 171 will be described later together with the anti-rotation ring 172.

At the same time, oil which is stored in the suction space 110*a* of the casing 110, that is, in the oil storage space defining the lower half of the suction space 110*a*, can be supplied into a gap between the front housing 112 and the orbiting scroll 130 (to be precise, between the thrust plate 135 and the front housing 112 and between the thrust plate 135 and the orbiting scroll 130, which will be described later) through the oil groove 1122*c*.

The anti-rotation pins 171 may extend integrally from the rear surface of the frame portion 1122 toward the orbiting scroll 130 or may be separately manufactured and then assembled. In this embodiment, an example in which the anti-rotation pin is press-fitted to the frame portion 1122 is illustrated.

The rear housing 113 according to the embodiment is formed in a substantially cylindrical shape with one end (front end) open and another end (rear end) closed. In other words, the front end of the rear housing 113 facing the fixed scroll 140, which will be described later, is open while the rear end facing the fixed scroll 140 is closed. Accordingly, an inner space of the rear housing 113 defines a discharge space 110*b* together with a rear surface of a fixed end plate 141, which will be described later, so as to accommodate refrigerant discharged from the compression chamber V.

The third housing protrusion 113*a* fastened by bolts to the second housing protrusion 111*b* extends from the front end of the rear housing 113 into a flange shape. The third housing protrusion 113*a* and the second housing protrusion 111*b* are fastened by bolts to each other with the second sealing member 182 interposed therebetween.

Although not illustrated, the second housing protrusion 111*b* and the rear housing 113 may be fastened by bolts to each other with a spacer (not illustrated) interposed therebetween. In this case, a sealing protrusion (not illustrated) may extend from the front end of the rear housing 113 toward the main housing 111, and a second sealing member (not illustrated) may be disposed between an outer circumferential surface of the sealing protrusion and the inner circumferential surface of the main housing 111.

A third connection protrusion (no reference numeral given) and a fourth connection protrusion (no reference numeral given) are formed on the closed rear end of the rear housing 113. The third connection protrusion is formed on a center of the rear end of the rear housing 113, and the fourth connection protrusion is formed near the third connection protrusion. A refrigerant discharge port 1131 is formed in the third connection protrusion, and a bypass port 1132 is formed in the fourth connection protrusion. The refrigerant discharge port 1131 and the bypass port 1132 are formed through between inner and outer surfaces of the rear housing 113.

An inner end of the refrigerant discharge port 1131 is open to an inner circumferential surface of the rear housing 113 to communicate with a discharge port 1411 to be described later, and an outer end of the refrigerant discharge port 1131 is connected to the refrigerant discharge pipe 116. Accordingly, the refrigerant discharge pipe 116 communicates with the inner space of the rear housing 113, that is, the discharge space 110*b* through the refrigerant discharge port 1131. The refrigerant discharge pipe 116 is connected to an inlet of the oil separator 161, and an outlet of the oil separator 161 is connected the condenser 20 of the refrigeration cycle constituting the gas engine heat pump 1 through the refrigerant circulation pipe 50.

An inner end of the bypass port 1132 is open to the inner circumferential surface of the rear housing 113 to communicate with a bypass guide groove 1411*c* to be described later, and an outer end of the bypass port 1132 is connected to the refrigerant return pipe 151. Accordingly, the inner space of the rear housing 113, that is, the bypass guide groove 1411*c* communicates with a first end 151*a* of the refrigerant return pipe 151 by the bypass port 1132. A second end 151*b* of the refrigerant return pipe 151 may be directly connected to the return port 1112 of the main housing 111 or may be connected to the main housing 111 through the oil return pipe 162. An example in which the second end 151*b* of the refrigerant return pipe 151 is directly connected to the return port 1112 of the main housing 111 is illustrated.

The drive shaft 120 according to this embodiment transmits driving force, which is transmitted through the clutch assembly 2, to the compression part, that is, the orbiting scroll 130. A portion of the drive shaft 120 is disposed outside the casing 110 and another portion of the drive shaft 120 is disposed inside the casing 110, respectively.

In detail, the drive shaft 120 includes a shaft portion 121 and a pin portion 122. The shaft portion 121 is coupled to the clutch assembly 2, and the pin portion 122 extends from the shaft portion 121 to be coupled to the orbiting scroll 130 with interposing an eccentric bush 125 to be described later therebetween. Accordingly, the driving force transmitted through the clutch assembly 2 is transmitted to the orbiting scroll 130 through the drive shaft 120.

The shaft portion 121 is disposed on the same axis as the shaft receiving portion 1121*b* and the lubrication space 1121*c* of the front housing 112. A front end of the shaft portion 121 is supported by the first support bearing 185 disposed in the front shaft receiving portion 1121*b*1 of the front housing 112, and a rear end of the shaft portion 121 is supported by the second support bearing 186 disposed in the rear shaft receiving portion 1121*b*2. The shaft portion 121 rotates while being radially supported at two points by the first support bearing 185 and the second support bearing 186 which are spaced apart from each other in the axial direction.

An oil passage (not illustrated) may be defined through the inside of the shaft portion 121. As the front end of the shaft portion 121 is exposed to the outside of the casing 110, the oil passage may be formed toward the lubrication space 1121*c* through an outer circumferential surface of the shaft portion 121 in a middle of the shaft portion 121.

The pin portion 122 extends axially from the rear end of the shaft portion 121 toward the orbiting scroll 130. The pin portion 122 is formed eccentrically with respect to an axial center O of the shaft portion 121, and the eccentric bush (or sliding bush) 125 is rotatably coupled to the pin portion 122. Accordingly, rotational force of the drive shaft 120 is transmitted to the orbiting scroll 130 with the eccentric bush 125 interposed therebetween, and the orbiting scroll 130 performs an orbiting motion by the anti-rotation mechanism 170.

A sub-balance weight 1251 that performs an orbiting motion in the shaft receiving portion 1121*b* of the front housing 112 may be formed integrally with the eccentric bush 125 or may be press-fitted into the eccentric bush 125. The sub-balance weight 1251 is formed in a semicircular shape on the same axis as the axial center O of the drive shaft 120, and is disposed at an opposite side to a direction in which the eccentric bush 125 is eccentric. Accordingly, the sub-balance weight 1251 rotates in the orbiting space 1122*a* of the front housing 112.

The orbiting scroll 130 is coupled to a rear end of the drive shaft 120 with the eccentric bush 125 interposed therebetween and is axially supported by the frame portion 1122 of the front housing 112. Accordingly, the orbiting scroll 130 performs the orbiting motion by receiving rotational force through the drive shaft 120 while being supported in the axial direction by the frame portion 1122 of the front housing 112.

In detail, the orbiting scroll 130 includes an orbiting end plate 131, an orbiting wrap 132, and a drive shaft coupling portion 133. The orbiting scroll 130 may be formed of a material lighter than that of the front housing 112, for example, an aluminum material. This can enhance efficiency of the compressor by reducing a load of a balance weight.

The orbiting end plate 131 is formed in a disk shape. The orbiting end plate 131 is provided with an orbiting wrap 132 formed on one side surface (rear surface) thereof and engaged with the fixed wrap 142 to be explained later so as to form the compression chamber V, and a driving shaft coupling portion 133 formed on another side surface (front surface) and coupled to the eccentric bush 125 to receive rotational force through the drive shaft 120. Accordingly, the rear surface of the orbiting end plate 131 forms the compression chamber V together with the front surface of the fixed end plate 141 to be described later, while the front surface of the orbiting end plate 131 is axially supported by the scroll support surface 1122*b* of the front housing 112 so as to define an axial bearing surface.

A thrust plate 135 may be provided between the rear surface of the orbiting end plate 131 and the scroll support surface 1122*b*. However, when the front housing 112 and the orbiting scroll 130 defining the axial bearing surface are made of different materials, the thrust plate 135 may be excluded. However, in the embodiment, an example in which the front housing 112 and the orbiting scroll 130 are made of different materials but the thrust plate 135 is interposed between the front housing 112 and the orbiting scroll 130 will be mainly described.

The thrust plate 135 may be formed of a material different from that of the orbiting scroll 130 or/and the front housing 112. For example, the front housing 112 may be formed of cast iron and the orbiting scroll 130 may be made of aluminum. The thrust plate 135 may be formed of a steel plate having greater rigidity than the material(s) of the front housing 112 or/and the orbiting scroll 130. This can allow more effective lubrication between the orbiting scroll 130 and the front housing 112.

The thrust plate 135 is formed in an annular shape. For example, the thrust plate 135 is formed substantially in the same shape as that of the scroll support surface 1122*b* of the front housing 112. Pin holes 1351 are formed in the thrust plate 135 so that the anti-rotation pins 171 are inserted. The pin holes 1351 are disposed at preset distances in the circumferential direction to correspond to the anti-rotation pins 171. Accordingly, the thrust plate 135 can be coupled to the scroll support surface 1122*b* of the front housing 112 by the anti-rotation pins 171.

A ring insertion groove 1311 is formed in the front surface of the orbiting end plate 131 so that the anti-rotation pin 171 constituting a portion of the anti-rotation mechanism 170 is pivotally inserted. Accordingly, the orbiting scroll 130 receiving the rotational force by the drive shaft 120 performs the orbiting motion by the anti-rotation ring 172 inserted into the ring insertion groove 1311 and the anti-rotation pin 171 inserted into the ring insertion groove 1311.

The ring insertion groove 1311 is provided in plurality disposed at preset distances in the circumferential direction. The ring insertion groove 1311 may be formed in a closed circular shape, or in some cases, may be formed in an open arcuate shape. The embodiment exemplarily illustrates that the ring insertion groove 1311 is formed in a circular shape.

The anti-rotation ring 172 constituting the portion of the anti-rotation mechanism 170 is rotatably inserted into the ring insertion groove 1311, and the anti-rotation pin 171 slides into the anti-rotation ring 172 in the circumferential direction. The anti-rotation ring 172 will be described later together with the anti-rotation pin 171.

The orbiting wrap 132 extends toward the fixed scroll 140 from one side surface (rear surface) of the orbiting end plate 131. The orbiting wrap 132 may be formed in various shapes, such as an involute shape, to correspond to the fixed wrap 143.

A tip seal groove may be formed in an axial end surface of the orbiting wrap 132, so that a tip seal member (no reference numeral given) can be inserted therein. This can suppress axial leakage between compression chambers through the axial end surface of the orbiting wrap 132.

The orbiting wrap 132 may extend up to an outer circumferential surface of the orbiting end plate 131. Accordingly, a wrap length of the orbiting wrap 132 can extend to the maximum, thereby maximizing a suction volume.

A first suction end 132*a* and a second suction end 142*a* which communicate independently with both compression chambers V1 and V2 may be formed on an end of the orbiting wrap 132 in a wrapping (rolling, winding) direction and an end of the fixed wrap 142 in a wrapping (rolling, winding) direction to be described later. This will be described later again together with the fixed wrap 142.

The drive shaft coupling portion 133 extends toward the front housing 112 from a geometric center of the orbiting scroll 130. The drive shaft coupling portion 133 is formed in a cylindrical shape, and a third support bearing 187 may be disposed between an inner circumferential surface of the drive shaft coupling portion 133 and an outer circumferential surface of the eccentric bush 125. The third support bearing 187 may be a bush bearing, a ball bearing, or a needle bearing. This embodiment illustrates an example in which the needle bearing is employed.

In the state where the fixed scroll 140 is inserted into the main housing 111, a front surface of the fixed scroll 140 is supported by being fixed to the front housing 112 and a rear surface thereof is supported by being fixed to the rear housing 113 in the axial direction. Accordingly, the inner space of the casing 110 is divided based on the fixed scroll 140 into a suction space 110*a* for accommodating the orbiting scroll 130 and a discharge space 110*b* including a portion of the fixed scroll 140, and the pair of compression chambers are formed while the orbiting scroll 130 perform the orbiting motion related to the fixed scroll 140.

In detail, the fixed scroll 140 includes a fixed end plate 141 and a fixed wrap 142.

The fixed end plate 141 is formed in a disk shape. An outer circumferential surface of the fixed end plate 141 may be inserted to be almost brought into contact with the inner circumferential surface of the casing 110, that is, the inner circumferential surface of the main housing 111. A third sealing member 183 may be inserted into an outer circumferential surface of the fixed end plate 141. This can tightly seal a gap between the outer circumferential surface of the fixed end plate 141 and the inner circumferential surface of the main housing 111, so that the inner space of the casing can be divided into the suction space 110*a* (and oil storage space) at the front side and the discharge space 110*b* at the rear side.

Although not illustrated, when the aforementioned sealing protrusion (not illustrated) is formed on the rear housing 113, the third sealing member (not illustrated) may be inserted between the inner circumferential surface of the sealing protrusion and the outer circumferential surface of the fixed end plate 141 facing it.

The discharge port 1411 is formed in a center of the fixed end plate 141. The discharge port 1411 may be a single portion formed to communicate with both compression chambers V, or may be provided in plurality disposed to communicate with both compression chambers V independently of each other. In this embodiment, an example in which one discharge port 1411 is formed is illustrated.

At least one bypass hole 1412*a*, 1412*b* may be formed in the vicinity of the discharge port 1411. The at least one bypass hole 1412*a*, 1412*b* may include an overcompression-suppressing bypass hole (hereinafter, referred to as a first bypass hole) 1412*a* for suppressing overcompression and/or a variable capacity bypass hole (hereinafter, referred to as a second bypass hole) 1412*b* for varying capacity. The first bypass hole 1412*a* may be independently formed for each compression chamber V in the vicinity of the discharge port 1411, and the second bypass hole 1412*b* may be independently formed for each compression chamber at a position farther away from the discharge port 1411 than the first bypass hole 1412*a*.

The discharge port 1411, the first bypass hole 1412*a*, and the second bypass hole 1412*b* are open and closed by valves, respectively. For example, the discharge port 1411 is open and closed by a discharge valve 145, the first bypass hole 1412*a* by a first bypass valve 146, and the second bypass hole 1412*b* by a second bypass valve 147.

The discharge valve 145, the first bypass valve 146, and the second bypass valve 147 may be configured independently, or may be integrally connected to each other. This embodiment illustrates an example in which the discharge valve 145 and the first bypass valve 146 are independently disposed, whereas the second bypass valve 147 is provided by two integrally connected to each other.

On the other hand, the discharge space 110*b* is defined between the rear surface of the fixed end plate 141 and the inner space of the rear housing 113 facing it. Here, the discharge space 110*b* may be divided into a first discharge space 110*b*1 and a second discharge space 110*b*. For example, a partition protrusion 1413 may extend from the rear surface of the fixed end plate 141 toward the rear housing 113 by a preset height.

The partition protrusion 1413 may be formed in a ring shape similar to an alphabet V when projected in the axial direction, so as to partition the discharge space 110*b* into the first discharge space 110*b*1 and the second discharge space 110*b*2. For example, the first discharge space 110*b*1 may be formed outside the partition protrusion 1413, and the second discharge space 110*b*2 may be formed inside the partition protrusion 1413, respectively.

The first discharge space 110*b*1 may communicate with the refrigerant discharge port 1131 described above, and the second discharge space 110*b*2 may communicate with the bypass port 1132 described above. The discharge valve 145 and the first bypass valve 146 belong to the first discharge space 110*b*1, and the second bypass valve 147 belongs to the second discharge space 110*b*2. Accordingly, the first discharge space 110*b*1 defines a substantial discharge space for guiding refrigerants, which are discharged from discharge pressure chambers (no reference numeral given) of the both compression chambers V or bypassed from first intermediate pressure chambers (no reference numeral given) of the both compression chambers V, toward the condenser 20 of the refrigeration cycle through the refrigerant discharge pipe 116 to be described later. And, the second discharge space 110*b*2 defines a kind of bypass space for guiding refrigerants, which are bypassed from intermediate compression chambers (second intermediate pressure chambers with pressure lower than the first intermediate pressure chambers) of the both compression chambers, to be returned into the suction space 110*a* of the casing 110 through the refrigerant return pipe 151 to be described later.

The partition protrusion 1413 may be formed only on the fixed end plate 141, but in some cases, may also be formed on the front surface of the rear housing 113 facing the fixed end plate 141. For example, a first partition protrusion 1413 (also, denoted by the same reference numeral of the partition protrusion for the sake of explanation) may be formed on the rear surface of the fixed end plate 141, and a second partition protrusion 1133 corresponding to the first partition protrusion may be formed on the front surface of the rear housing 113. In this case, the refrigerant discharge port 1131 may be located outside the second partition protrusion 1133 and a bypass port 1132 may be located inside the second partition protrusion 1133, respectively.

A bypass guide groove 1413*a* is formed inside the partition protrusion 1413. The bypass guide groove 1413*a* is formed in a substantially V-like shape to accommodate the second bypass holes 1412*b* of the both compression chambers V. When the partition protrusion is divided into the first partition protrusion 1413 and the second partition protrusion 1133, the bypass guide groove may be formed in each of the first partition protrusion 1413 and the second partition protrusion 1133, or in any one of the partition protrusions.

The fixed wrap 142 extends toward the orbiting scroll 130 from one side surface (front surface) of the fixed end plate 141. The fixed wrap 142 and the orbiting wrap 132 may be formed in various shapes, such as an involute shape, to correspond to the orbiting wrap 132.

A tip seal groove may be formed in an axial end surface of the fixed wrap 142, so that a tip seal member (no reference numeral given) can be inserted therein. This can suppress axial leakage between compression chambers through the axial end surface of the fixed wrap 142.

The fixed wrap 142 may extend up to the outer circumferential surface of the fixed end plate 141, like the orbital wrap 132. Accordingly, a wrap length of the fixed wrap 142 can extend to the maximum, thereby maximizing a suction volume.

The fixed wrap 142 is disposed such that an end thereof in a wrapping direction has a phase difference of about 180° from an end of the orbiting wrap 132 in a wrapping direction thereof. For example, a first suction end 132*a* to be described later is formed on an outer end of the orbiting wrap 132, and a second suction end 142*a* is formed on an outer end of the fixed wrap 142, respectively. Accordingly, the fixed wrap 142 forms so-called symmetrical compression chambers together with the orbital wrap 132.

Referring to FIGS. 2 to 4, a refrigerant return unit 150 according to the embodiment includes a refrigerant return pipe 151 and a first control valve 152.

As described above, the refrigerant return pipe 151 is configured such that a first end 151*a* is fastened to the third connection protrusion (no reference numeral given) of the rear housing 113 to be connected to the bypass port 1132 communicating with the second discharge space 110*b*2, and a second end is fastened to the second connection protrusion of the main housing 111 to be connected to the return port 1112 communicating with the suction space 110*a*. Accordingly, refrigerants bypassed from both compression chambers V forming the second intermediate pressure chambers to the bypass guide groove 1413*a* are suctioned again after circulating the suction space 110*a* of the casing 110 through the refrigerant return pipe 151.

The first control valve 152 is disposed in a middle portion of the refrigerant return pipe 151 to open and close the refrigerant return pipe 151. The first control valve 152 may be a check valve or a solenoid valve that is open and closed by receiving an electrical signal transmitted from a controller (not illustrated) of the gas engine heat pump 1. In this embodiment, an example in which the first control valve 152 is a solenoid valve is illustrated. Accordingly, the first control valve 152 is open when it is necessary to lower the capacity of the compressor, such that refrigerant bypassed by the bypass guide groove 1413*a* circulates to the suction space 110*a* of the casing 110, thereby switching the compressor into a saving operation mode.

An oil return unit 160 according to the embodiment includes an oil separator 161, an oil return pipe 162, and a second control valve 163.

Referring to FIGS. 2 to 4, the refrigerant discharge pipe 116 is connected to an upper half of the oil separator 161, and the refrigerant circulation pipe 50 which is connected to the inlet of the condenser is connected to an upper end (or upper surface) of the oil separator 161. In addition, the oil return pipe 162 which is joined to the refrigerant return pipe 151 toward the suction space of the casing 110 is connected to a lower end (or lower half) of the oil separator 161. Accordingly, refrigerant and oil discharged to the first discharge space 110*b*1 of the casing 110 are introduced into the oil separation space 161*a* of the oil separator 161 through the refrigerant discharge pipe 116, and separated from each other in the oil separation space 161*a* by a kind of cyclonic effect. Gas refrigerant separated in an oil separation space 161*a* moves to the condenser 20 through the refrigerant circulation pipe 50, while liquid oil separated in the oil separation space 161*a* is accumulated in the lower portion of the oil separation space 161*a* so as to be returned into the suction space 110*a* of the casing 110 via the oil return pipe 162 and the refrigerant return pipe 151.

As described above, the oil return pipe 162 is configured such that a first end 162*a* is connected to the oil separator 161 disposed in the refrigerant discharge pipe 116 at the outside of the casing 110, and a second end 162*b* is connected to a middle portion of the refrigerant return pipe 151. In other words, the first end 162*a* of the oil return pipe 162 is connected to a second outlet side located in the lower half of the oil separator 161, and the second end 162*b* of the oil return pipe 162 may be connected to the refrigerant return pipe 151 at a downstream side rather than the first control valve 152. Accordingly, the oil separated in the oil separator 161 moves through the oil return pipe 162, and flows into the refrigerant return pipe 151 to be returned into the suction space 110*a* of the casing 110 through the return port 1112.

The second control valve 163 is disposed in a middle portion of the oil return pipe 162 to open and close the oil return pipe 162. The second control valve 163 may be a check valve or a solenoid valve that is open and closed by receiving an electrical signal transmitted from a controller (not illustrated) of the gas engine heat pump 1. In this embodiment, an example in which the second control valve 163 is a solenoid valve is illustrated. Accordingly, when the compressor requires oil, the second control valve 163 is open such that the oil separated in the oil separator 161 is returned into the suction space 110*a* of the casing 110, thereby reducing friction loss in the compressor and improving reliability.

Although not illustrated, the second control valve 163 may be excluded or may be configured as a check valve for preventing reverse flow. In this case, the oil separated in the oil separator 161 may be continuously returned to the suction space.

Although not illustrated, the second end 162*b* of the oil return pipe 162 may be fastened to the second connection protrusion to be directly connected to the return port 1112, and the second end 151*b* of the refrigerant return pipe 151 may be connected to the middle of the oil return pipe 162. Even in this case, the second end 151*b* of the refrigerant return pipe 151 may be connected to the oil return pipe 162 at the downstream side rather than the second control valve 163.

In the drawings, reference numeral 126 denotes a main balance weight.

The scroll compressor according to the embodiment may operate as follows.

That is, when an operation for the gas engine heat pump 1 is selected, the clutch assembly 2 transmits driving force to the drive shaft 120. The driving force transmitted to the drive shaft 120 is transmitted to the orbiting scroll 130 through the drive shaft 120.

Then, in the state in which the orbiting scroll 130 is supported by the front housing 112, the orbiting scroll 130 performs an orbiting motion by an eccentric distance of the eccentric bush 125. During the orbiting motion, a pair of compression chambers V each including a suction chamber, an intermediate pressure chamber, and a discharge chamber are continuously formed between the orbiting wrap 132 and the fixed wrap 142. The compression chambers V are decreased in volume as moving toward the center during the continuous orbiting motion of the orbiting scroll 130, and refrigerant is compressed while moving along the compression chambers V and then discharged into the discharge space 110*b*, more accurately, the first discharge space 110*b*1 through the discharge port 1411.

At this time, the refrigerant in each compression chamber V may be compressed up to a set pressure while moving from the intermediate pressure chamber to the discharge pressure chamber, but the pressure of the refrigerant may rise over the preset pressure due to other conditions occurred during the operation of the compressor. Then, the refrigerant moving from the intermediate pressure chamber to the discharge pressure chamber is partially bypassed in advance from each compression chamber V to the discharge space 110*b*, more precisely, the first discharge space 110*b*1 through the first bypass hole 1412*a*. This can suppress overcompression of the refrigerant above the set pressure in each compression chamber V, so as to increase efficiency of the compressor and to secure stability for the orbital wrap 132 and the fixed wrap 142 constituting the compression part.

In addition, the gas engine heat pump 1 including the compressor 10 may vary an operating capacity as needed during operation. For example, in the case of a power operation, the first control valve 152 of the refrigerant return unit 150 is closed to secure a maximum suction volume, whereas in the case of a saving operation, the first control valve 152 of the refrigerant return unit 150 is open so as to substantially minimize the suction volume.

In other words, during the saving operation, as the first control valve 152 is open, the second discharge space 110*b*2 communicates with the suction space 110*a*. Then, the refrigerant suctioned into the compression chambers V are partially bypassed to the second discharge space through the second bypass hole 1412*b*. This refrigerant flows into the suction space 110*a* through the refrigerant return pipe 151 and the return port 1112 by a pressure difference between the second discharge space 110*b*2 and the suction space 110*a*, and then suctioned into each of the both compression chambers V1 and V2 through the first suction end 132*a* and the second suction end 142*a*.

On the other hand, the refrigerant discharged to the first discharge space 110*b*1 through the discharge port 1411 and the first bypass hole 1412*a* flows toward the condenser 20 of the refrigeration cycle device through the refrigerant discharge port 1131 and the refrigerant discharge pipe 116. However, oil is contained in the refrigerant discharged from each compression chamber V to the first discharge space 110*b*1.

As described above, when refrigerant and oil are both discharged from the compressor 10 toward the refrigeration cycle device, an oil shortage may occur in the casing 110 constituting the compressor 10. In particular, the scroll compressor 10 included in the gas engine heat pump 1 does not store a large amount of oil due to a small internal volume of the casing 110. Accordingly, the oil separator 161 is disposed between the scroll compressor 10 and the condenser 20 included in the gas engine heat pump 1, to separate oil discharged from the compressor 10 from refrigerant, such that the oil is returned to the compressor 10.

The oil separator 161 may be disposed inside the compressor 10 or outside the compressor 10. As in the embodiment, when the oil separator 161 is disposed outside the compressor 10, that is, in the middle of the refrigerant discharge pipe 116, the oil return pipe 162 through which the oil separated in the oil separator 161 is returned into the casing 110 of the compressor 10 is provided. However, when the oil return pipe 162 is provided, the shape of the compressor for connecting the oil return pipe 162 or the piping around the compressor may be complicated.

Accordingly, in the embodiment, the oil return pipe may be joined to the refrigerant return pipe and connected to the casing of the compressor. Accordingly, the piping around the compressor can be simplified by unifying the refrigerant return pipe and the oil return pipe.

In addition, in this embodiment, the refrigerant return pipe connected to the oil separation pipe or the refrigerant return pipe may be disposed close to the axial bearing surface between the front housing and the orbiting scroll. Accordingly, oil can be quickly supplied between the front housing and the orbiting scroll, thereby reducing friction loss between the front housing and the orbiting scroll, which may result in improving efficiency of the compressor.

In addition, in the embodiment, an oil groove may be formed in the scroll support surface of the front housing or the front surface of the orbiting end plate facing the scroll support surface. Accordingly, even if the front housing and the orbiting scroll (or thrust plate) are in close contact with each other, oil can be quickly introduced into a gap between the front housing and the orbiting scroll through the oil groove, thereby further reducing friction loss.

Meanwhile, as described above, in the scroll compressor according to the embodiment, the anti-rotation pin is inserted into the front housing and the anti-rotation ring is inserted into the orbiting scroll, respectively, to suppress the rotation of the orbiting scroll.

However, as the related art anti-rotation ring is completely embedded in the ring insertion groove of the orbiting scroll, the front surface of the orbiting end plate and the rear surface of the thrust plate come into close contact with each other. As a result, sufficient oil is not supplied to the axial bearing surface between the orbiting scroll and the thrust plate. This may cause wear due to an increase in friction loss or an occurrence of seizure on the axial bearing surface. Even when the thrust plate is excluded, a similar phenomenon may occur between the front housing and the orbiting scroll.

Accordingly, in the embodiment of the present disclosure, a spacer may be disposed between the front housing and the orbiting scroll, specifically, between the thrust plate and the orbiting scroll. However, the spacer may be configured using an existing part, namely, the anti-rotation ring, without adding a separate part. Through this, oil can be quickly and sufficiently supplied to the axial bearing surface between the thrust plate and the orbiting scroll, thereby suppressing friction loss or seizure on the axial bearing surface.

Figure 5:
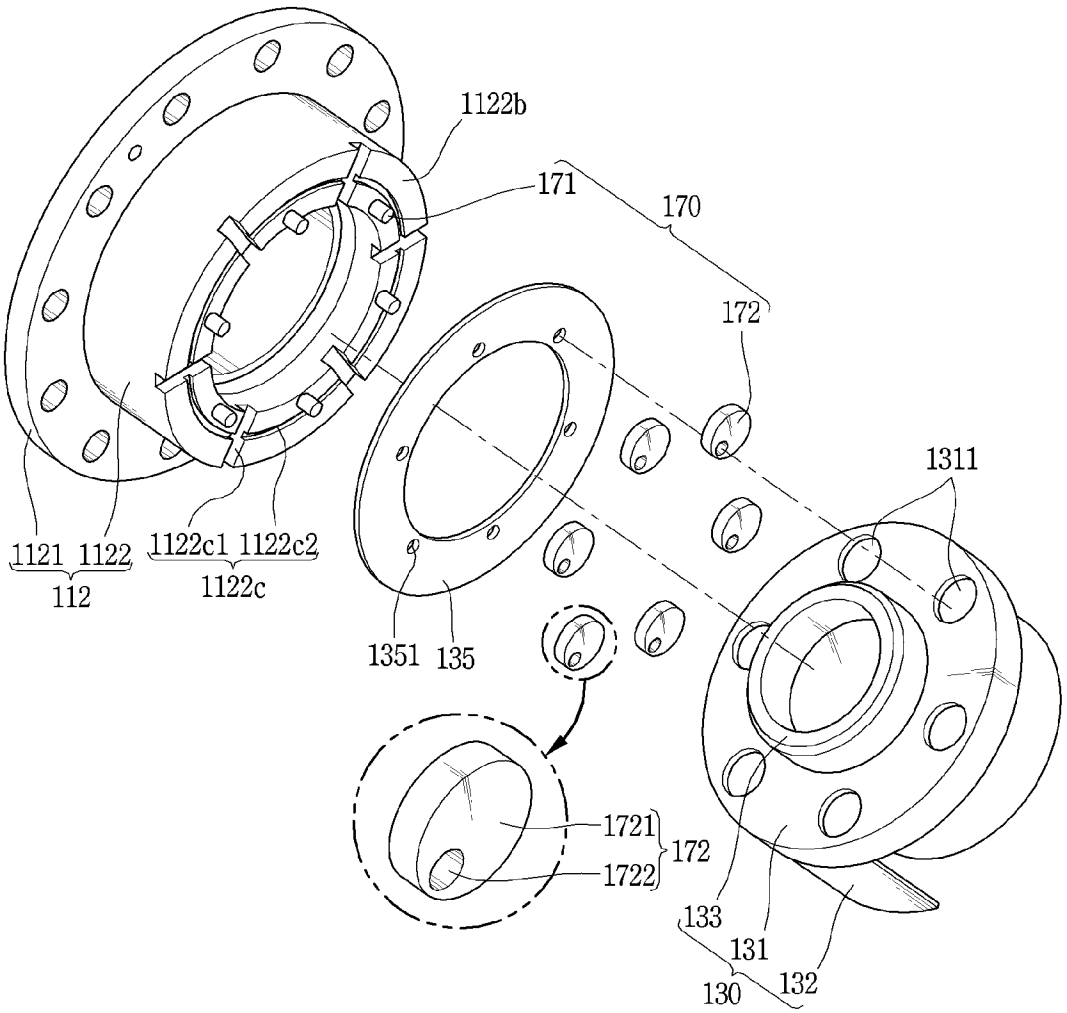
FIG. 5 is an exploded perspective view illustrating a compression part in a scroll compressor in accordance with an embodiment of the present disclosure.
Figure 6:
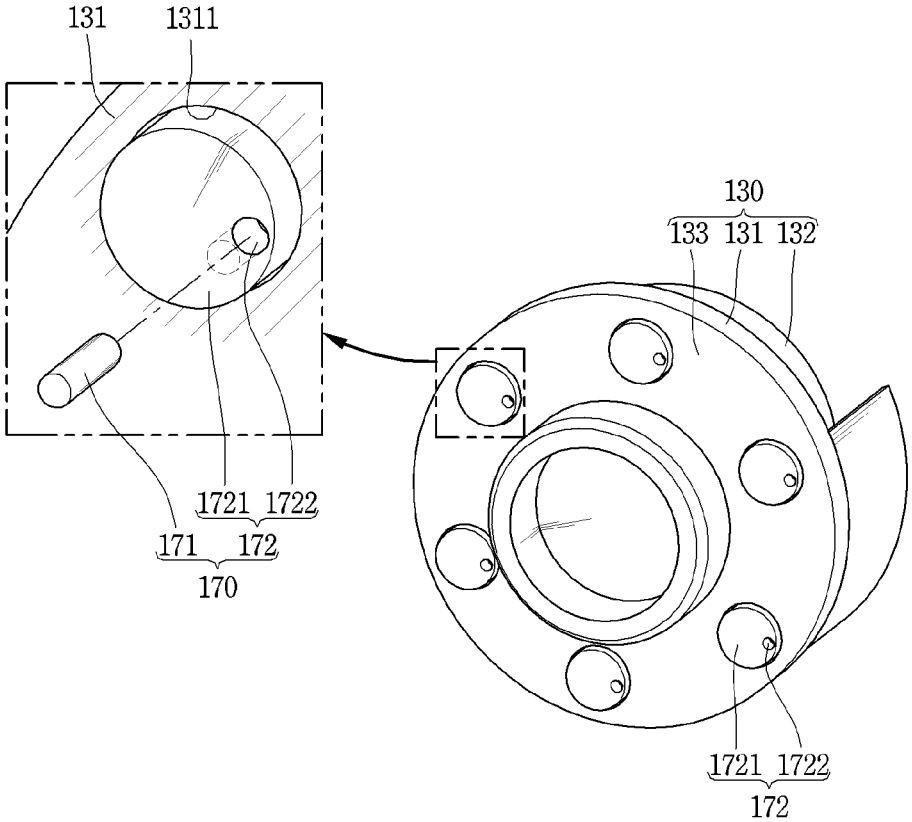
FIG. 6 is a perspective view illustrating a rear surface of an orbiting scroll, to which an anti-rotation ring is coupled, in FIG. 5.
Figure 7:
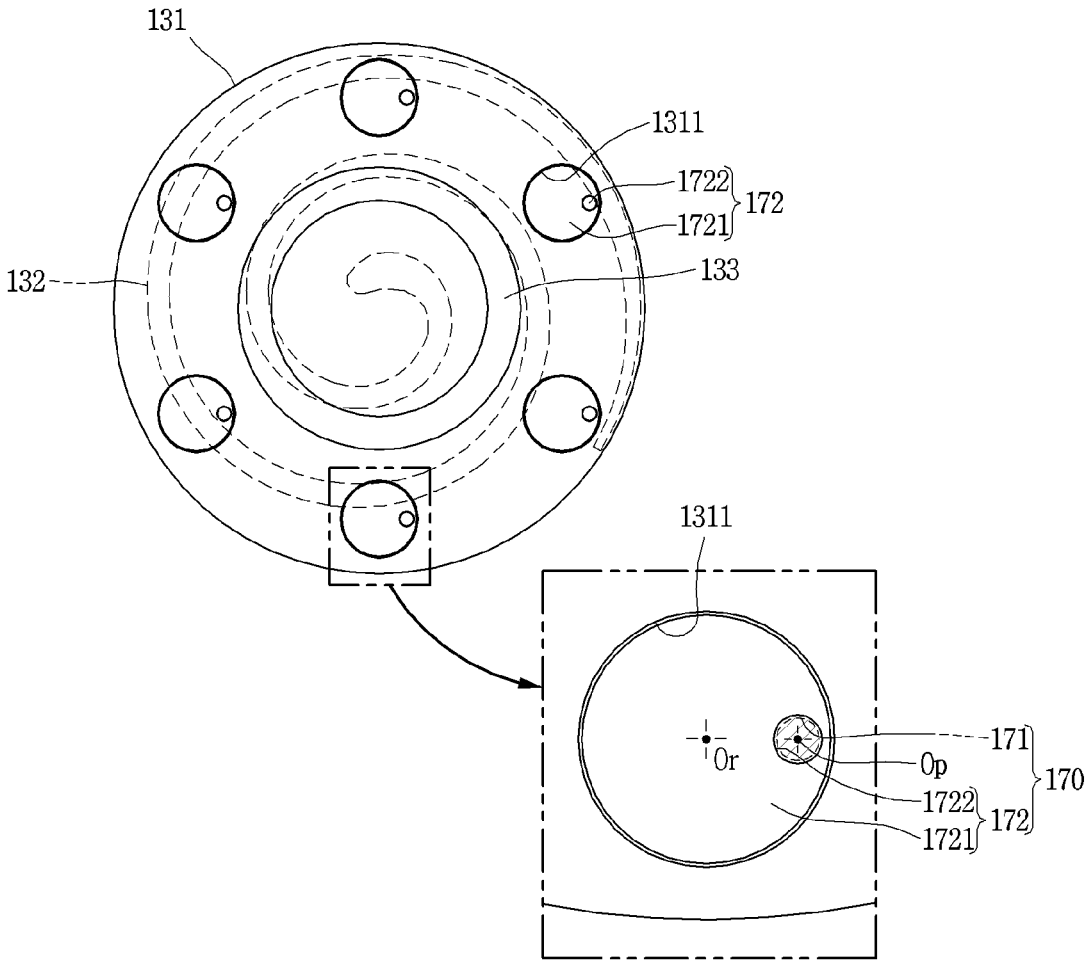
FIG. 7 is a rear view of FIG. 6.
Figure 8:
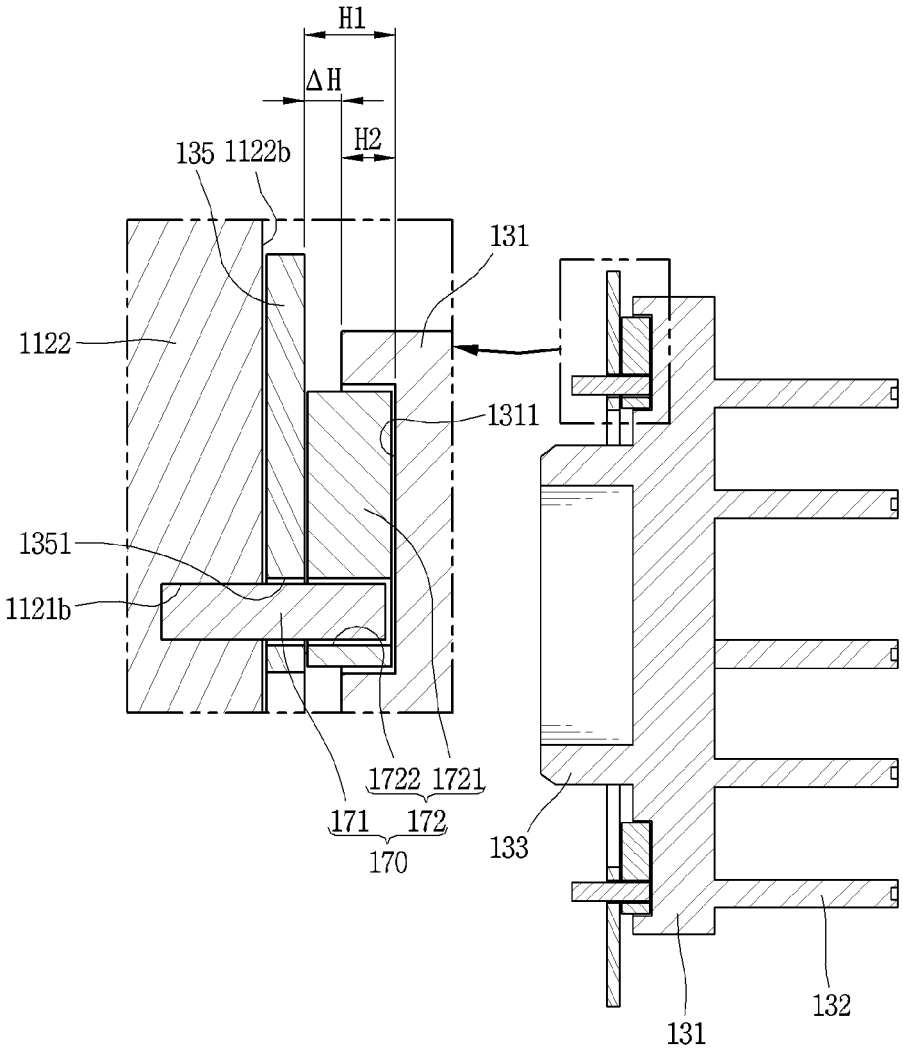
FIG. 8 is a cross-sectional view of FIG. 7.

FIG. 5 is an exploded perspective view illustrating a compression part in a scroll compressor in accordance with an embodiment of the present disclosure, FIG. 6 is a perspective view illustrating a rear surface of an orbiting scroll, to which an anti-rotation ring is coupled, in FIG. 5, FIG. 7 is a rear view of FIG. 6, and FIG. 8 is a cross-sectional view of FIG. 7.

Referring to FIGS. 5 to 8, the anti-rotation mechanism 170 according to the embodiment may include an anti-rotation pin 171 and an anti-rotation ring 172. These anti-rotation pin 171 and anti-rotation ring 172 form a pair, and a plurality of pairs are arranged at an equal distance one by one along the circumferential direction.

Specifically, the anti-rotation pin 171 is formed in a small circular rod shape, and may be formed of a material having hardness and strength higher than those of the orbiting scroll 130 and the front housing 112. In other words, the anti-rotation pin 171 is formed in a small circular rod shape which has an inner diameter smaller than that of a pin coupling portion 1722 of the anti-rotation ring 172 to be described later, and may be made of a material, such as steel, which has hardness and strength higher than those of the orbiting scroll 130 made of aluminum or the front housing 112 made of cast iron. Accordingly, the anti-rotation pin 171 cannot be damaged and can maintain reliability even if the anti-rotation pin 171 is coupled to the anti-rotation ring 172 to suppress the rotation of the orbiting scroll 130.

The anti-rotation pins 171 are disposed at an equal distance along the circumferential direction on the rear surface of the front housing 112, that is, the scroll support surface 1122*b*. The anti-rotation pins 171 can be rotatably coupled to the pin insertion grooves 1122*d* formed in the scroll support surface 1122*b*, or may be firmly press-fitted into the pin insertion grooves 1122*d*. In this embodiment, an example in which the anti-rotation pins 171 are press-fitted into the pin insertion grooves 1122*d* is illustrated. This can prevent the anti-rotation pins 171 from being separated from the front housing 112 when assembling the compressor, which can be advantageous in terms of assembling property.

An end portion of each anti-rotation pin 171, that is, an end portion to be inserted into the anti-rotation ring 172 may be chamfered to be tapered or curved. This can facilitate the anti-rotation pin 171 to be inserted into a pin coupling portion 1722 of the anti-rotation ring 172 to be described later.

The anti-rotation ring 172 according to this embodiment may include a ring body portion 1721 and a pin coupling portion 1722. The ring body portion 1721 is inserted into the ring insertion groove 1311 to support the orbiting scroll 130 in the axial direction with respect to the thrust plate 135 disposed at an opposite side, and the anti-rotation pin 171 is rotatably inserted into the pin coupling portion 1722 to support the anti-rotation pin 171 in a rotational direction. Accordingly, the anti-rotation ring 172 slides in the ring insertion groove 1311 in the circumferential direction and performs an orbiting motion centering on the anti-rotation pin 171 to constrain the rotation of the orbiting scroll 130.

Specifically, the ring body portion 1721 according to this embodiment may be formed of the same material as the anti-rotation pin 171. For example, the ring body portion 1721 may be formed of a steel material. This can minimize wear of the ring body portion 1721 of the anti-rotation ring 172 due to the anti-rotation pin 171 even if the anti-rotation pin 171 slides in the pin coupling portion 1722 in the circumferential direction.

The ring body portion 1721 may be formed in a disk shape. For example, the ring body portion 1721 may be formed in a disk shape having a substantially same axial thickness as a whole. However, in some cases, the ring body portion 1721 may be formed to be partially thick or thin. This embodiment will be mainly described based on an example in which the entire ring body portion 1721 has the same axial thickness.

The ring body portion 1721 is formed in a disk shape in a manner that an outer diameter of the ring body portion 1721 is slightly smaller than an inner diameter of the ring insertion groove 1311. Accordingly, the anti-rotation ring 172 can be slidably coupled to the ring insertion groove 1311 in the circumferential direction.

An axial thickness H1 of the ring body portion 1721 may be larger than an axial depth H2 of the ring insertion groove 1311. Accordingly, a portion of the ring body portion 1721 protrudes out of the ring insertion groove 1311 to come into contact with the thrust plate 135. Then, a spacing ΔH is generated between the orbiting scroll 130 and the thrust plate 135 by a height of the portion of the ring body portion 1721 protruding to the outside of the ring insertion groove 1311. Oil is then introduced into a gap defined by the spacing ΔH so as to lubricate between the orbiting scroll 130 and the thrust plate 135.

However, when the axial thickness H1 of the ring body portion 1721 is too thick, it excessively protrudes from the ring insertion groove 1311. This may reduce supporting force for the orbiting scroll 130, which may make a behavior of the orbiting scroll 130 unstable. As a result, compression loss may occur due to leakage between the compression chambers. Therefore, the axial thickness H1 of the ring body portion 1721 may be preferably formed to be equal to or smaller than twice the axial depth H2 of the ring insertion groove 1311.

The pin coupling portion 1722 may be formed to be eccentric from a center Oc of the ring body portion 1721. In other words, the pin coupling portion 1722 is formed inside the ring body portion 1721, specifically, formed axially through the ring body portion 1721 at a position eccentric from the center of the ring body portion 1721 by a preset distance. Alternatively, the pin coupling portion 1722 may be recessed by a predetermined depth from one side surface of the ring body portion 1721 facing the thrust plate 135 to an opposite side.

The pin coupling portion 1722 is to be rotatably coupled to the anti-rotation pin 171 as described above, and thus an inner diameter of the pin coupling portion 1722 may be slightly larger than an outer diameter of the anti-rotation pin 171. Accordingly, when the ring body portion 1721 turns in the ring insertion groove 1311, the anti-rotation pin 171 slides in the pin coupling portion 1722 in the circumferential direction, which can constrain the rotation of the orbiting scroll 130.

When the anti-rotation mechanism according to the embodiment is disposed between the front housing 112 and the orbiting scroll 130, that is, between the thrust plate 135 and the orbiting scroll 130, the orbiting scroll 130 is spaced apart from the thrust plate 135 in the axial direction.

That is, the axial thickness H1 of the anti-rotation ring 172 according to the embodiment is formed to be larger than the axial depth H2 of the ring insertion groove 1311 into which the anti-rotation ring 172 is inserted. Accordingly, even if the anti-rotation ring 172 is inserted into the ring insertion groove 1311, the anti-rotation ring 172 is partially exposed outside the ring insertion groove 1311.

Then, the anti-rotation ring 172 forms a kind of thrust bearing surface. Accordingly, the rear surface of the thrust plate 135 is lifted by a protruded height of the anti-rotation ring 172 without coming into contact with the front surface of the orbiting end plate 131. Then, oil is introduced into a gap between the lifted rear surface of the thrust plate 135 and the front surface of the orbiting end plate 131, thereby forming an oil film. This can suppress an occurrence of friction loss or/and seizure between the rear surface of the thrust plate 135 and the front surface of the orbiting end plate 131 during the operation of the compressor.

Hereinafter, a description will be given of another embodiment of an anti-rotation mechanism.

That is, in the foregoing implementation, the ring body portion of the anti-rotation ring is formed in the disk shape, but in some cases, the ring body portion may further include a weight-reducing portion.

Figure 9:
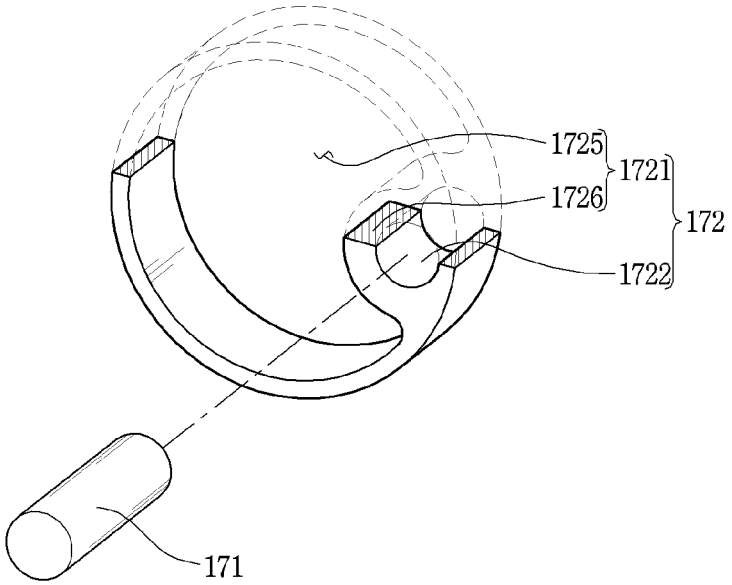
FIG. 9 is a cut perspective view illustrating another embodiment of an anti-rotation ring.
Figure 10:
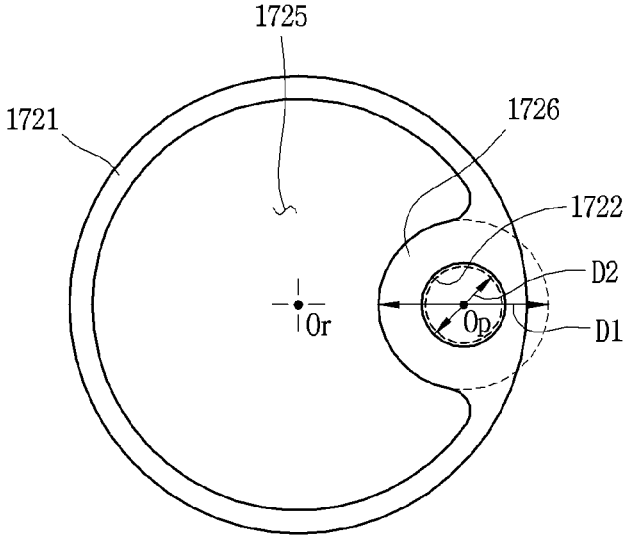
FIG. 10 is a planar view of FIG. 9.
Figure 11:
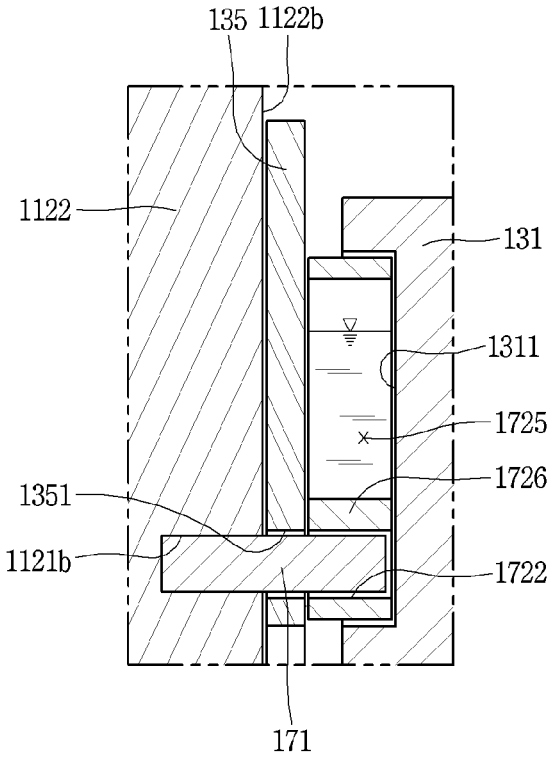
FIG. 11 is a cross-sectional view of FIG. 10.
Figure 12:
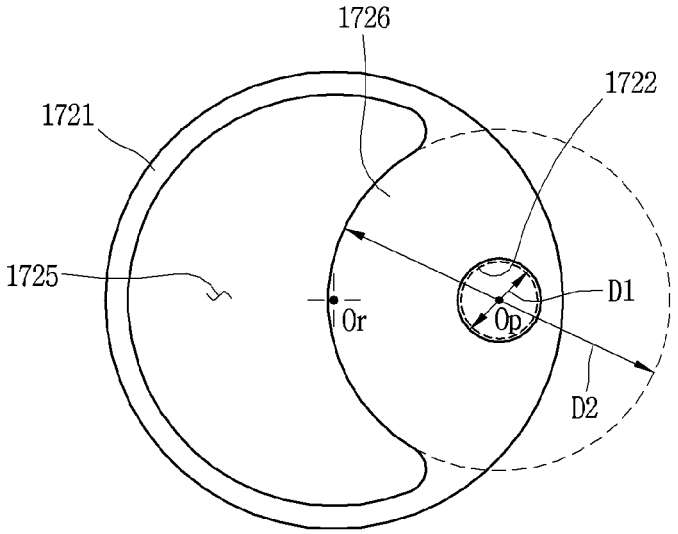
FIG. 12 is a planar view illustrating still another embodiment of an anti-rotation ring.

FIG. 9 is a cut perspective view illustrating another embodiment of an anti-rotation ring, FIG. 10 is a planar view of FIG. 9, FIG. 11 is a cross-sectional view of FIG. 10, and FIG. 12 is a planar view illustrating still another embodiment of an anti-rotation ring.

Referring to FIGS. 9 to 12, the basic configuration of the anti-rotation pin 171 and the anti-rotation ring 172 constituting the anti-rotation mechanism 170 of the scroll compressor according to this embodiment and the effects thereof are the same as those of the previous embodiment. Therefore, a detailed description thereof will be replaced with the description for the previous embodiment.

However, in this embodiment, a weight-reducing portion 1725 may further be disposed in the anti-rotation ring 172. This can reduce a weight of the anti-rotation ring 172 and thus reduce a weight of a rotating body including the anti-rotation ring 172, thereby enhancing efficiencies of the compressor and the gas engine heat pump including the same.

For example, as illustrated in FIGS. 9 and 10, the anti-rotation ring 172 includes a ring body portion 1721 and a pin coupling portion 1722, and further include a weight-reducing portion 1725 having a preset area in the ring body portion 1721.

The weight-reducing portion 1725 may be eccentrically formed at a position that does not overlap the pin coupling portion 1722. In other words, since the pin coupling portion 1722 is formed eccentrically to one side from a center Or of the ring body portion 1721, the weight-reducing portion 1725 may be formed eccentrically to an opposite side of the pin coupling portion 1722 from the center Or of the ring body portion 1721.

Specifically, the weight-reducing portion 1725 according to this embodiment may be formed through both axial side surfaces of the ring body portion 1721. In other words, the weight-reducing portion 1725 is formed in the shape of a hole in the ring body portion 1721, in a manner that an outer circumferential surface of the weight-reducing portion 1725 defines an inner circumferential surface of the ring body portion 1721 and an inner circumferential surface of the weight-reducing portion 1725 defines an outer circumferential surface of a reinforcing portion 1726 to be described later. Accordingly, the weight of the ring body portion 1721 can be minimized.

The reinforcing portion 1726 is a portion in contact with the weight-reducing portion 1725, and the outer circumferential surface of the reinforcing portion 1726 defines the inner circumferential surface of the weight-reducing portion 1725. In other words, the reinforcing portion 1726 may be formed to surround the pin coupling portion 1722 from one side of the weight-reducing portion 1725. This can secure rigidity of the pin coupling portion 1722 even while forming the weight-reducing portion 1725 in the ring body portion 1721.

Also, in this case, both ends of the reinforcing portion 1726 may be curved. This can suppress crack caused due to concentration of stress on the both ends of the reinforcing portion 1726, in other words, on portions of the ring body portion 1721 where the reinforcing portion 1726 is connected on an inner circumferential surface of an edge side.

An area of the reinforcing portion 1726 is inversely proportional to the area of the weight-reducing portion 1725. For example, when the area of the reinforcing portion 1726 is increased, the area of the weight-reducing portion 1725 is decreased. Therefore, it is advantageous in terms of reducing the weight of the anti-rotation ring 172 to form the area of the reinforcing portion 1726 as small as possible. Accordingly, the area of the reinforcing portion 1726 may preferably be formed to be smaller than or equal to the area of the weight-reducing portion 1725.

The outer circumferential surface of the reinforcing portion 1726 (i.e., the inner circumferential surface of the weight-reducing portion) may be formed to be curved. For example, the outer circumferential surface of the reinforcing portion 1726 is formed as a circular curved surface having the same center as a center Op of the pin coupling portion 1722, and an outer diameter D1 of the reinforcing portion 1726 may be about two times larger than or equal to or four times smaller than or equal to an inner diameter D2 of the pin coupling portion 1722.

As illustrated in FIG. 10, when the outer diameter D1 of the reinforcing portion 1726 is formed to be approximately twice as large as the inner diameter D2 of the pin coupling portion 1722, the area of the weight-reducing portion 1725 is much larger than the area of the reinforcing portion 1726. Accordingly, the weight of the anti-rotation ring 172 can be greatly reduced.

As illustrated in FIG. 12, when the outer diameter D1 of the reinforcing portion 1726 is formed to be approximately four times as large as the inner diameter D2 of the pin coupling portion 1722, the area of the weight-reducing portion 1725 is slightly larger than the area of the reinforcing portion 1726. In other words, a radial width of the reinforcing portion 1726 is increased compared to that in the embodiment of FIG. 10. This can effectively suppress damage to the pin coupling portion 1722 (or the reinforcing portion 1726).

In addition, as in the embodiments of FIGS. 10 and 12, when the weight-reducing portion 1725 is formed in the ring body portion 1721, an inner space of the weight-reducing portion 1725 may define a kind of oil storage space. Accordingly, a certain amount of oil is stored between the anti-rotation ring 172 and the thrust plate 135 which constitute the substantial axial bearing surface, thereby enhancing a lubrication effect on the axial bearing surface.

Hereinafter, a description will be given of still another embodiment of an anti-rotation mechanism.

That is, in the foregoing embodiments, the weight-reducing portion of the anti-rotation ring is formed in the hole shape, but in some cases, the weight-reducing portion 1725 may be formed in a groove shape.

Figure 13:
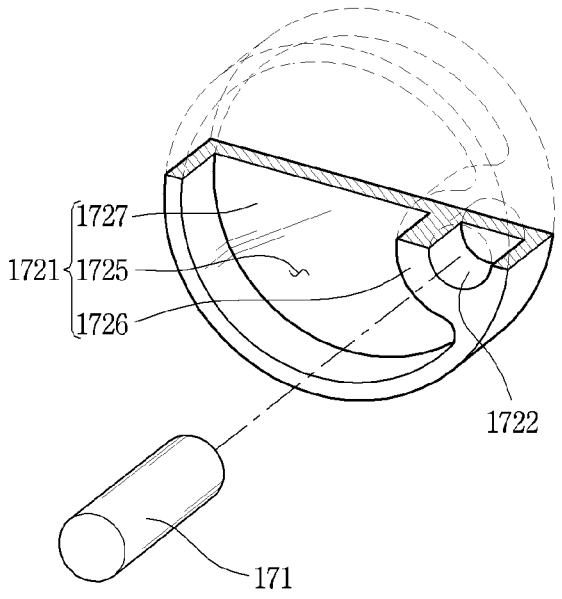
FIG. 13 is a cut perspective view illustrating still another embodiment of an anti-rotation ring.
Figure 14A:
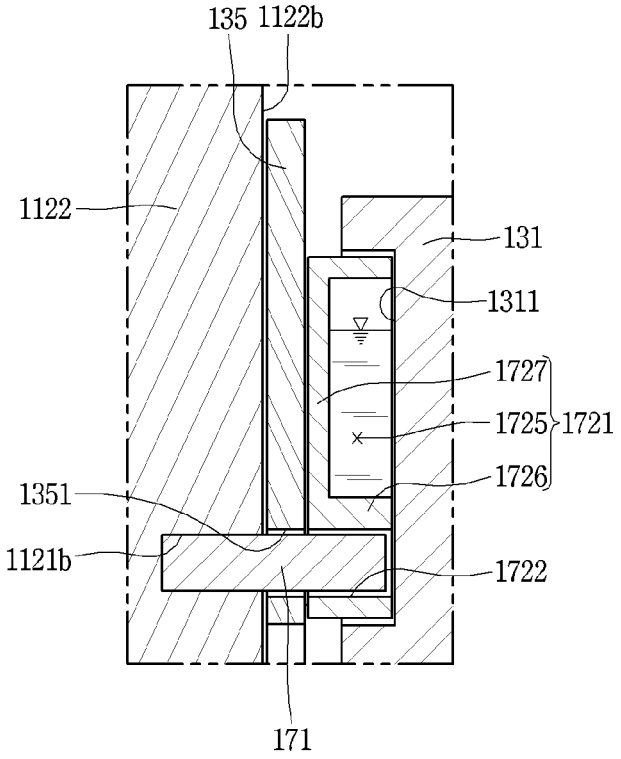
FIGS. 14A and 14B are cross-sectional views each illustrating an installation example for the anti-rotation ring of FIG. 13.
Figure 14B:
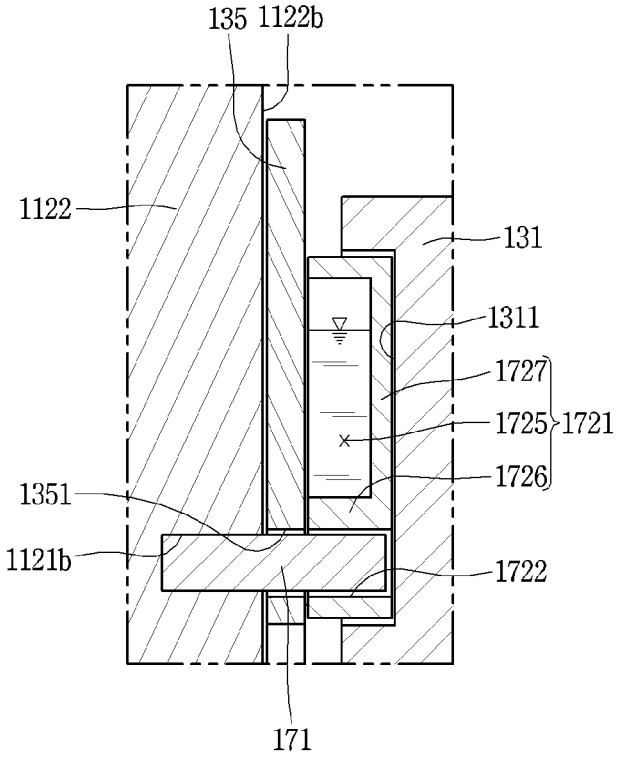

FIG. 13 is a cut perspective view illustrating still another embodiment of an anti-rotation ring, and FIGS. 14A and 14B are cross-sectional views each illustrating an installation example for the anti-rotation ring of FIG. 13.

Referring to FIGS. 13 to 14B, the basic configuration of the anti-rotation pin 171 and the anti-rotation ring 172 constituting the anti-rotation mechanism 170 of the scroll compressor according to this embodiment and the effects thereof are the same as those of the previous embodiment of FIG. 19. Therefore, a detailed description thereof will be replaced with the description for the previous embodiment of FIG. 19.

However, in this embodiment, the weight-reducing portion 1725 is disposed in the ring body portion 1721 of the anti-rotation ring 172, in a manner of being recessed from one side surface to another side surface of the ring body portion 1721.

As illustrated in FIG. 14A, the weight-reducing portion 1725 according to the embodiment may be recessed from an opposite side surface of the thrust plate 135, namely, a rear surface of the ring body portion 1721 to a front surface of the ring body portion 1721 facing the thrust plate 135 by a preset depth. Accordingly, the anti-rotation ring 172 of this embodiment is provided with the weight-reducing portion 1725 formed in the ring body portion 1721 as in the embodiment of FIG. 9, which can reduce a weight of the anti-rotation ring 172, thereby improving efficiency of the gas engine heat pump including the compressor.

In addition, in this embodiment, as the weight-reducing portion 1725 is formed in a groove shape, an opposite side surface of the weight-reducing portion 1725 forms a kind of sliding portion 1727. In other words, as illustrated in the embodiment, when the weight-reducing portion 1725 is recessed from the rear to front surfaces of the ring body portion 1721, the front surface of the ring body portion 1721 in contact with the thrust plate 135 may be maintained in a disk shape, thereby defining the sliding portion 1727. Accordingly, the anti-rotation ring 172 has the weight-reducing portion 1725 and the sliding portion 1727 blocked (closed) at an opposite side of the weight-reducing portion. This can reduce surface pressure of the anti-rotation ring 172 with respect to the thrust plate 135. With the configuration, reliability of the anti-rotation ring 172 can be secured and the orbiting scroll 130 can be more stably supported.

In addition, the weight-reducing portion 1725 according to the embodiment may be formed as in the embodiment of FIG. 9, but in this embodiment, the weight-reducing portion 1725 may be formed to have an area significantly larger than that of the reinforcing portion 1726, as in the embodiment of FIG. 14A. In other words, in this embodiment, the sliding portion 1727 is formed at an opposite side surface of the weight-reducing portion 1725, and connected to the reinforcing portion 1726. Accordingly, the sliding portion 1727 may substantially have a shape extending from the reinforcing portion 1726, and overall rigidity of the reinforcing portion 1726 can be increased. This can minimize the width of the reinforcing portion 1726 and stably maintain the pin coupling portion 1722.

On the other hand, as illustrated in FIG. 14B, the weight-reducing portion 1725 may be formed in a groove shape in the ring body portion 1721, and may be formed in an opposite direction to that in the embodiment of FIG. 14A. For example, the weight-reducing portion 1725 may be recessed from the front surface to the rear surface of the ring body portion 1721. In this case, the sliding portion 1727 is formed on the rear surface of the ring body portion 1721, that is, on a surface in contact with the orbiting scroll 130 (an inner wall surface of the ring insertion groove).

As described above, when the sliding portion 1727 is formed on the rear surface of the ring body portion 1721, the sliding portion 1727 of the ring body portion 1721 is slidably in contact with the inner wall surface of the ring insertion groove 1311 in an inserted state into the ring insertion groove 1311 of the orbiting scroll 130. This can suppress an increase in surface pressure of the anti-rotation ring 172 with respect to the orbiting scroll 130, thereby securing reliability of the anti-rotation ring 172 and enhancing supporting force for the orbiting scroll 130.

In addition, in this embodiment, the weight-reducing portion 1725 is formed in the front surface of the ring body portion 1721 facing the thrust plate 135, as in the embodiment of FIG. 9, and thus an inner space of the weight-reducing portion 1725 may define a kind of oil storage space. Accordingly, a certain amount of oil is stored between the anti-rotation ring 172 and the thrust plate 135 which constitute the substantial axial bearing surface, thereby enhancing a lubrication effect on the axial bearing surface.

Hereinafter, a description will be given of still another embodiment of an anti-rotation mechanism.

That is, in the previous embodiments, one end of the anti-rotation pin is fixed to the front housing and another end of the anti-rotation pin is rotatably inserted into the anti-rotation ring, but in some cases, the anti-rotation pin may be integrally formed with the anti-rotation ring and rotatably inserted into the front housing.

Figure 15:
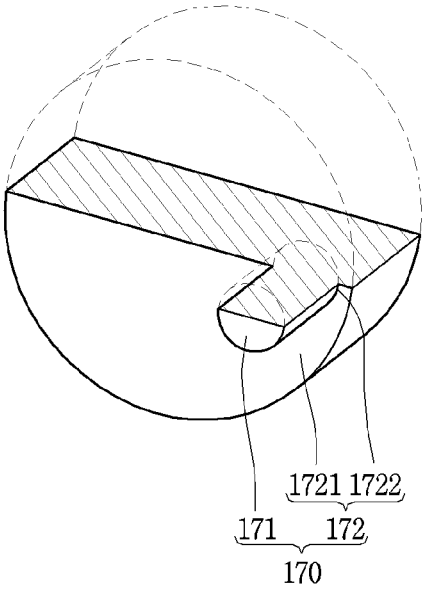
FIG. 15 is a cut perspective view illustrating still another embodiment of an anti-rotation ring.
Figure 16:
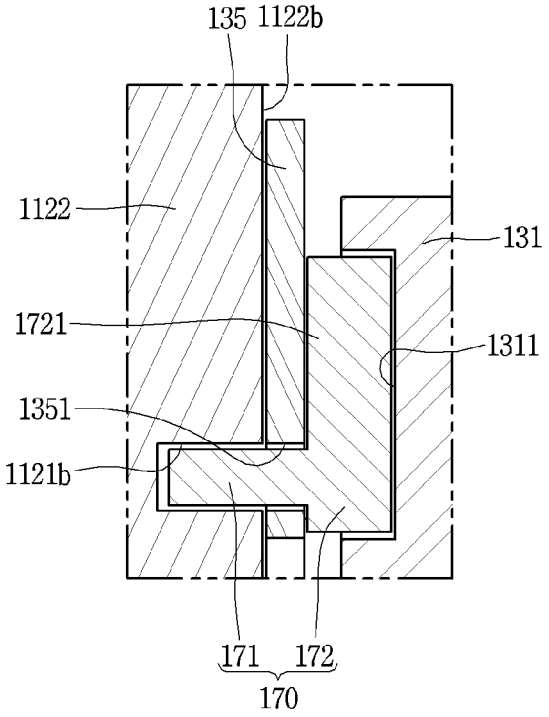
FIG. 16 is a cross-sectional view of FIG. 15.

FIG. 15 is a cut perspective view illustrating still another embodiment of an anti-rotation ring, and FIG. 16 is a cross-sectional view of FIG. 15.

As illustrated in FIGS. 15 and 16, the basic configuration of the anti-rotation pin 171 and the anti-rotation ring 172 constituting the anti-rotation mechanism 170 of the scroll compressor and the operating effects thereof are the same as those in the embodiments illustrated in FIGS. 6, 10, 12, and 13, and thus a detailed description thereof will be replaced with the description of those embodiments of FIGS. 6, 10, 12, and 13.

However, in this embodiment, the anti-rotation pin 171 may be fixedly inserted into the pin coupling portion 1722 of the anti-rotation ring 172 or may extend integrally from the pin coupling portion 1722. For example, in this embodiment, one end of the anti-rotation pin 171 may be inserted into the front housing 112, and another end of the anti-rotation pin 171 may be press-fitted to or integrally formed with the pin coupling portion 1722 eccentric from the ring body portion 1721 of the anti-rotation ring 172.

In this case, a pin insertion groove 1122*d* may be formed in the scroll support surface 1122*b* of the front housing 112, and one end of the anti-rotation pin 171 may be rotatably inserted into the pin insertion groove 1122*d*. For example, the pin insertion groove 1122*d* may be formed as a circular groove like the anti-rotation pin 171, such that an inner diameter of the pin insertion groove 1122*d* is slightly larger than an outer diameter of the anti-rotation pin 171. Accordingly, the anti-rotation ring 172 slides in the circumferential direction with respect to the ring insertion groove 1311 disposed in the orbiting scroll 130, while the anti-rotation pin 171 slides in the circumferential direction with respect to the pin insertion groove 1122*d* disposed in the front housing 112. With the configuration, the orbiting scroll 130, which receives the rotational force of the drive shaft 120, performs an orbiting motion while the rotation of the orbiting scroll 130 is constrained by the anti-rotation pin 171 and the anti-rotation ring 172.

When the anti-rotation pin 171 is formed integrally with the anti-rotation ring 172, there is no need to separately assemble the anti-rotation pin 171 and the anti-rotation ring 172 when assembling the compressor, which can reduce the number of processes for the compressor. This may result in more reducing a manufacturing cost than those in the previous embodiments.

Meanwhile, in the previous embodiments, the example in which the oil separator 161 is disposed outside the casing 110 has been described, but the present disclosure will be equally applied even to a case in which the oil separator 161 is disposed inside the casing 110.

In addition, in the previous embodiments, the so-called open scroll compressor in which the driving source is disposed outside the casing 110 has been described, but the present disclosure may be equally applied even to a so-called hermetic scroll compressor in which the drive motor constituting the driving source is disposed inside the casing 110.

Also, in the previous embodiments, the example in which the thrust plate 135 is disposed between the front housing 112 and the orbiting scroll 130 has been described, but the present disclosure may be equally applied even when the thrust plate is excluded.

In addition, in the previous embodiments, the example in which the anti-rotation pin 171 is coupled to the front housing 112 and the anti-rotation ring 172 is coupled to the orbiting scroll 130 has been described, but the present disclosure may be equally applied even to a case where the anti-rotation pin 171 is coupled to the orbiting scroll 130 and the anti-rotation ring 172 is coupled to the front housing 112, respectively.

What is claimed is:

1. A scroll compressor comprising:

a casing;

a fixed scroll disposed in the casing;

an orbiting scroll configured to engage the fixed scroll and define a compression chamber together with the fixed scroll;

a scroll support member disposed at a side of the orbiting scroll in an axial direction and configured to support the orbiting scroll in the axial direction;

an anti-rotation pin disposed at one of a side surface of the orbiting scroll or a side surface of the scroll support member facing the side surface of the orbiting scroll;

a ring insertion groove defined at a side surface of a portion that faces the anti-rotation pin; and an anti-rotation ring including:

a ring body portion inserted into the ring insertion groove and configured to rotate relative to the ring insertion groove, and a pin coupling portion disposed at the ring body portion and configured to couple the anti-rotation pin, wherein an axial thickness of the ring body portion is greater than an axial depth of the ring insertion groove, wherein an oil groove is defined at a side surface of the scroll support member facing the orbiting scroll, wherein the oil groove fluidly connects an outer circumferential surface to an inner circumferential surface of the scroll support member, and wherein the oil groove includes:

a plurality of first oil grooves that extend between the outer circumferential surface and the inner circumferential surface of the scroll support member and that are spaced apart from each other along a circumferential direction of the scroll support member, and at least one second oil groove that is defined in an annular shape along the circumferential direction of the scroll support member and that is in fluid communication with the plurality of first oil grooves.

2. The scroll compressor of claim 1, wherein the axial thickness of the ring body portion is smaller than or equal to twice the axial depth of the ring insertion groove.

3. The scroll compressor of claim 1, wherein the pin coupling portion is offset from a center of the ring body portion.

4. The scroll compressor of claim 1, wherein the pin coupling portion is defined through side surfaces of the ring body portion in the axial direction or recessed from one of the side surfaces of the ring body portion, and wherein an inner diameter of the pin coupling portion is larger than an outer diameter of the anti-rotation pin.

5. The scroll compressor of claim 4, wherein a first end of the anti-rotation pin is fixed to the scroll support member, and a second end of the anti-rotation pin is rotatably coupled to the pin coupling portion.

6. The scroll compressor of claim 1, wherein the anti-rotation pin extends integrally from the pin coupling portion, and wherein a pin insertion groove is defined at the scroll support member and receives the anti-rotation pin to enable the anti-rotation pin to rotate.

7. The scroll compressor of claim 1, wherein a weight-reducing portion is defined through side surfaces of the ring body portion in the axial direction or recessed from one of the side surfaces of the ring body portion.

8. The scroll compressor of claim 1, wherein an oil separator is disposed outside the casing and configured to separate oil from refrigerant discharged from the casing, wherein an oil return pipe connects the oil separator and an inside of the casing, and wherein the oil return pipe is connected to the inside of the casing at a position that faces a portion between the orbiting scroll and the scroll support member in a radial direction.

9. The scroll compressor of claim 1, wherein a weight-reducing portion is recessed from one of the side surfaces of the ring body portion.

10. The scroll compressor of claim 1, wherein the ring body portion has a disk shape and is entirely blocked except for the pin coupling portion.

11. The scroll compressor of claim 10, wherein the ring body portion has a consistent height.

12. The scroll compressor of claim 1, wherein the ring body portion includes a weight-reducing portion at a side of the pin coupling portion.

13. The scroll compressor of claim 12, wherein the ring body portion includes a reinforcing portion that is disposed between the weight-reducing portion and the pin coupling portion and surrounds the pin coupling portion.

14. The scroll compressor of claim 13, wherein an area of the reinforcing portion is smaller than or equal to an area of the weight-reducing portion.

15. The scroll compressor of claim 13, wherein the reinforcing portion is provided based on the weight-reducing portion being spaced apart from the pin coupling portion in a radial direction, and wherein an outer circumferential surface of the reinforcing portion includes a curved surface having the same center as a center of the pin coupling portion.

16. The scroll compressor of claim 15, wherein an outer diameter of the reinforcing portion is twice larger than or four times smaller than an inner diameter of the pin coupling portion.

17. A scroll compressor, comprising:

a casing;

a fixed scroll disposed in the casing;

an orbiting scroll configured to engage the fixed scroll and define a compression chamber;

a scroll support member disposed at a side of the orbiting scroll in an axial direction and configured to support the orbiting scroll in the axial direction;

an anti-rotation pin disposed at one of a side surface of the orbiting scroll or a side surface of the scroll support member facing the side surface of the orbiting scroll;

a ring insertion groove defined at a side surface of a portion that faces the anti-rotation pin; and an anti-rotation ring including:

a ring body portion inserted into the ring insertion groove and configured to rotate relative to the ring insertion groove, and a pin coupling portion disposed at the ring body portion and configured to couple the anti-rotation pin, wherein the pin coupling portion is offset from a center of the ring body portion, and wherein an axial thickness of the ring body portion is smaller than or equal to twice an axial depth of the ring insertion groove, wherein an oil separator is disposed outside the casing and configured to separate oil from refrigerant discharged from the casing, wherein an oil return pipe connects the oil separator and an inside of the casing, and wherein the oil return pipe is connected to the inside of the casing at a position that faces a portion between the orbiting scroll and the scroll support member in a radial direction, wherein an oil groove is defined at a side surface of the scroll support member facing the orbiting scroll, wherein the oil groove fluidly connects an outer circumferential surface to an inner circumferential surface of the scroll support member, and wherein the oil groove includes:

a plurality of first oil grooves that extend between the outer circumferential surface and the inner circumferential surface of the scroll support member and that are spaced apart from each other along a circumferential direction of the scroll support member, and at least one second oil groove that is defined in an annular shape along the circumferential direction of the scroll support member and that is in fluid communication with the plurality of first oil grooves.

18. The scroll compressor of claim 17, wherein the pin coupling portion is defined through side surfaces of the ring body portion in the axial direction or recessed from one of the side surfaces of the ring body portion, and wherein an inner diameter of the pin coupling portion is larger than an outer diameter of the anti-rotation pin.

19. The scroll compressor of claim 18, wherein a first end of the anti-rotation pin is fixed to the scroll support member, and a second end of the anti-rotation pin is rotatably coupled to the pin coupling portion.

20. The scroll compressor of claim 17, wherein the ring body portion has a disk shape and is entirely blocked except for the pin coupling portion.

* * * * *